US007431300B2

(12) United States Patent
Parker et al.

(10) Patent No.: US 7,431,300 B2
(45) Date of Patent: Oct. 7, 2008

(54) CONVERSATION GENERATOR

(76) Inventors: Mary L. Parker, P.O. Box 222184, Carmel, CA (US) 93922; Bob Summers, 1342 Sheffield Glen Way, Atlanta, GA (US) 30329

( * ) Notice: Subject to any disclaimer, the term of this patent is extended or adjusted under 35 U.S.C. 154(b) by 54 days.

(21) Appl. No.: 11/416,084

(22) Filed: May 1, 2006

(65) Prior Publication Data

US 2006/0192332 A1 Aug. 31, 2006

Related U.S. Application Data

(63) Continuation of application No. 09/925,443, filed on Aug. 9, 2001, now Pat. No. 7,093,832.

(51) Int. Cl.
*A63F 1/00* (2006.01)

(52) U.S. Cl. ..... 273/292

(58) Field of Classification Search ..... 273/236, 273/292

See application file for complete search history.

(56) References Cited

U.S. PATENT DOCUMENTS

| | | | | | |
|---|---|---|---|---|---|
| 2,224,683 | A * | 12/1940 | Knox et al. | 40/324 |
| 3,551,919 | A * | 1/1971 | Forbes | 4/623 |
| 4,103,452 | A * | 8/1978 | Wood | 446/142 |
| 4,207,673 | A * | 6/1980 | DiGirolamo et al. | 30/142 |
| 4,765,623 | A * | 8/1988 | Cardillo et al. | 273/161 |
| 4,922,355 | A * | 5/1990 | Dietz et al. | 362/101 |
| 4,975,682 | A * | 12/1990 | Kerr et al. | 340/573.1 |
| 5,211,699 | A * | 5/1993 | Tipton | 362/101 |
| 5,421,089 | A * | 6/1995 | Dubus et al. | 30/142 |
| 5,482,277 | A * | 1/1996 | Young | 273/161 |
| 5,575,553 | A * | 11/1996 | Tipton | 362/101 |
| 5,729,922 | A * | 3/1998 | Peterson et al. | 40/324 |
| 5,884,421 | A * | 3/1999 | Key | 40/306 |
| 6,005,204 | A * | 12/1999 | Choi et al. | 200/52 R |
| 6,135,845 | A * | 10/2000 | Klimpert et al. | 446/297 |
| 6,149,011 | A * | 11/2000 | Csengeri et al. | 206/763 |
| 6,163,248 | A * | 12/2000 | Paek et al. | 340/321 |
| 6,164,793 | A * | 12/2000 | Wu | 362/101 |
| 6,419,384 | B1 * | 7/2002 | Lewis et al. | 362/562 |
| 6,464,222 | B1 * | 10/2002 | Parker | 273/236 |
| 6,488,430 | B1 * | 12/2002 | Jimenez | 401/195 |
| 6,511,197 | B1 * | 1/2003 | Kalemjian | 362/101 |
| 6,525,660 | B1 * | 2/2003 | Surintrspanont | 340/572.1 |
| 6,533,120 | B1 * | 3/2003 | Csengeri | 206/565 |
| 6,580,662 | B2 * | 6/2003 | Vassallo | 368/11 |
| 6,793,362 | B2 * | 9/2004 | Tai | 362/101 |
| 7,087,865 | B2 * | 8/2006 | Lerner | 219/445.1 |
| 7,093,832 | B2 * | 8/2006 | Parker | 273/236 |

* cited by examiner

*Primary Examiner*—Gene Kim
*Assistant Examiner*—Dolores R. Collins
(74) *Attorney, Agent, or Firm*—Dickstein, Shapiro, LLP.

(57) ABSTRACT

A conversation promoting apparatus that includes a utilitarian object and at least one selectively actuatable microchip attached to the utilitarian object. Each actuatable microchip is preprogrammed with at least one signal that is emitted from the utilitarian object when the microchip is actuated.

12 Claims, 53 Drawing Sheets

FRONT

FRONT

BACK

TOP

SIDE

TOP

SIDE

SIDE

TOP

SIDE

SIDE

SIDE VIEW

FRONT VIEW

CONVERSATION GENERATOR

CROSS REFERENCE TO RELATED APPLICATIONS

The present application is a continuation of application Ser. No. 09/925,443, filed Aug. 9, 2001 now U.S. Pat. No. 7,093,832.

BACKGROUND OF THE INVENTION

The present invention relates generally to a method and apparatus for generating conversation, provoking thought, entertainment and education, and more particularly a method and apparatus for coupling a construction with an article having an alternative utility, the construction including one or more phrases and a delivery system for evoking an opinion type response to the one or more phrases.

During any occasion or event where a group of people who may or may not know each other are brought together, often conversation between them, and particularly the start up of conversation, may be difficult. Also, there are many occasions where an individual is alone and may desire some diversion.

Therefore, it would be beneficial to provide a method and apparatus that overcame these difficulties in the prior art.

SUMMARY OF THE INVENTION

Generally speaking, in accordance with the invention, a method and apparatus for providing question statements, phrases or the like that are open ended, and that evoke an opinion are provided in a manner so as to be attached to a utilitarian object. In accordance with the method or apparatus of the invention, a utilitarian object such as a paper plate, cup or the like, is provided that includes such statements thereon, allows for an attachment to be attached to a permanent-type object, or allows for an article of manufacture that may be attached to any object providing the functionality noted above. Also, conversation and thought provoking ideas may be provided via: tableware, electronics, various audio and visual media, microchips, paper pads and other functional objects. These objects are used to solicit opinions, not to demand answers. In any of these forms of the invention, the user of such a utilitarian object is provided with one or more statements as noted above assisting in generation of conversation, yet need not actively obtain an additional object for this purpose.

Further, tableware, such as glasses, dishes, napkin rings, napkins, placemats, eating utensils, table decorations, party favors, place cards, name cards and the like, are commonly used as service pieces for entertaining guests, such as at dinner parties and other social gatherings and may include these statements. A table setting at a dinner party may traditionally include multiple tableware pieces sufficient to facilitate service of multiple courses of a meal, such as an appetizer, a salad, soup, an entree, and a desert. However, such tableware may also be used in less formal situations for entertaining either large or small groups of people. Either way, a large number of objects are available for attachment of conversation-generating statements.

The invention exploits the breakdown of meaningful communication among families, peer groups and other social constituencies. Conversation within these groups is often unfocused, unstimulating and ultimately unsatisfying. Therefore, in accordance with the invention a method and apparatus are provided to provide the necessary prompting/stimulation/pro-vocation to engender fun, lively exchanges and thought among people in various age groups, people who may or may not have common interests, or the like.

While entertaining, it is common for hosts to attempt to facilitate conversation among their guests. However, this frequently develops into semi-private conversations among small subgroups of individuals. These conversations often become superficial in nature. It is sometimes preferable to attempt to engage guests in a group discussion to facilitate conversation among new acquaintances and/or promote the developments of new relationships. By way of non-limiting example, it is preferable to facilitate group discussion among guests during social gathering such as picnics, dinner parties, brunches, retreats, cruises, or the like.

In accordance with the broad teachings of this invention, an apparatus and method capable of facilitating conversation or discussion between two or more persons and a method of using the same is provided. The method includes: providing an open-ended question placed on a surface of a conversationware piece; providing a revealing member operably coupled to the conversationware piece, the revealing member being positioned generally over the open-ended question and selectively actuatable to reveal the open-ended question; actuating the revealing member to reveal the open-ended question; reading aloud the open-ended question printed on the conversationware piece; answering aloud the open-ended question; and engaging at least one other of the conversation partners in open discussion.

It is therefore an object of the invention to provide an improved method and apparatus to overcome the prior art. Other objects and advantages of the invention will in part be obvious and will in part be apparent from the specification and drawings.

The invention accordingly comprises the several steps and the relation of one or more of such steps with respect to each of the others, and the apparatus embodying the features of construction, combinations of elements and arrangement of parts that are adapted to effect such steps, all as exemplified in the following detailed disclosure and the scope of the invention will be indicated in the claims.

BRIEF DESCRIPTION OF THE DRAWINGS

For a more complete understanding of the invention, reference is made to the following description and accompanying drawings in which.

DETAILED DESCRIPTION OF THE PREFERRED EMBODIMENTS

Figure 1:
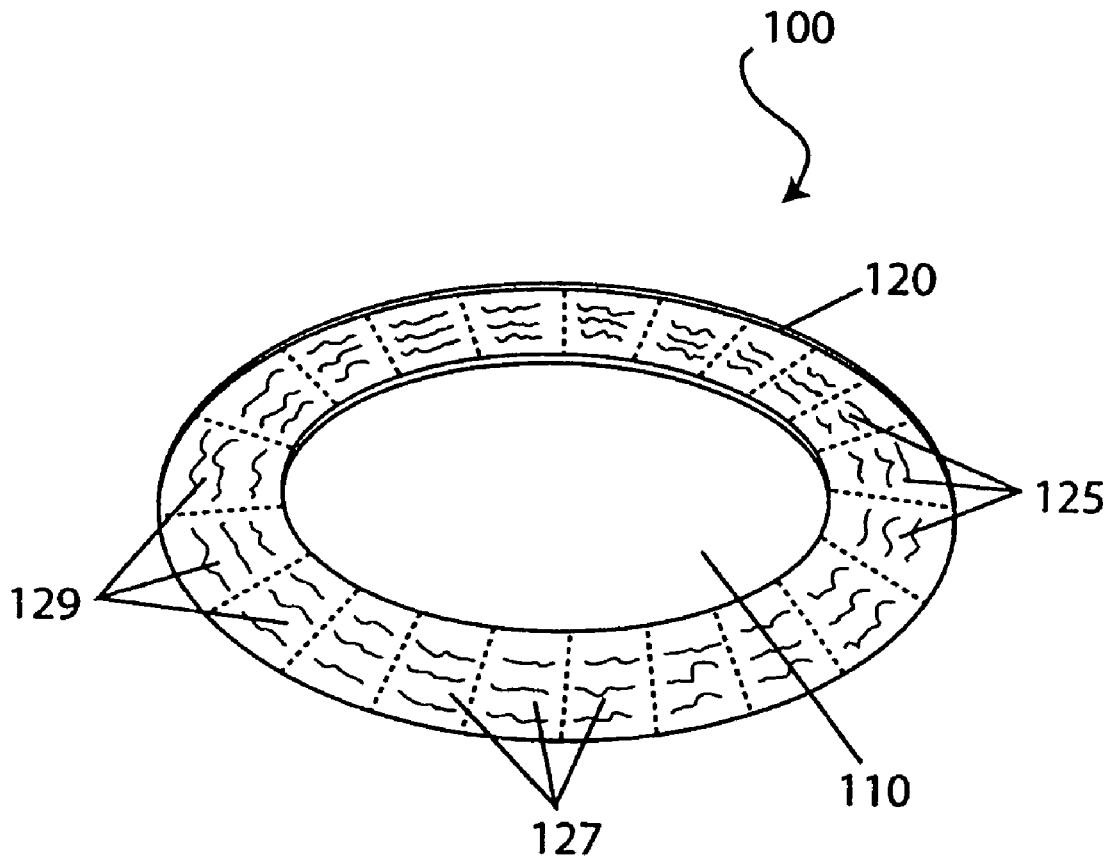
FIG. 1 is a top plan view of a plate constructed in accordance with a first embodiment of the invention.

Referring first to FIG. 1, a disposable plate 100 constructed in accordance with a first embodiment of the invention is shown. This disposable plate may be formed of paper, polystyrene, STYROFOAM∩, plastic, synthetic resin, EARTHSHELL™, BIOMAX™ or any other desirable material. As is shown in FIG. 1, plate 100 includes a bottom flat surface 110 for placing food, and raised side surfaces 120. Raised side surfaces 120 are provided with one or a plurality of perforations 127 positioned radially to raised side surfaces 120. Each adjacent pair of these perforations 127 defines a tab 125. As is further shown in FIG. 1, textual material 129 is written on each of these tabs 125. The tabs are designed so that they may be selectively and individually ripped away from the plate as desired. In a preferred embodiment, a question or the like is provided on the visible topside of tabs 125, and the underneath may include an answer to the noted question, if the question is one that lends itself to an answer, or a follow-up question.

In accordance with an alternative embodiment of the invention, a statement or other thought-provoking, opinion-evoking statement is placed on the top of each of the tabs. Additionally, the top of the tab may be color-coded for one or more topics and a statement or other thought-provoking, opinion-evoking statement corresponding to the topic of a particular color may be provided on the underneath.

Thus, if a user is at a dinner party, cocktail party or the like and is utilizing a plate constructed in accordance with this embodiment of the invention, it is easy for the user to meet and discuss new topics with people they have not previously met. It would be possible for the user to select a question or comment or other statement from the plate, and ask a nearby standing person his or her opinion on the topic. Because the questions are preferably open ended, the answers thereto generating an opinion, conversations are intended to be more in depth than a simple yes-no answer or conversations about other trivial topics. A follow-up question may also be provided on the underside of the tab.

Further in accordance with the invention, in each package including a plurality of plates, all of the plates may be identical so that users can each read a similar question. Alternatively, all of the plates in a package may be different so that each user will have different questions, therefore increasing the number of questions, comments or statements available to the group.

While questions may be provided on random subjects, specific theme-type plates may also be provided in accordance with the invention. For example, during a Superbowl party, questions related to the Superbowl might be provided. Similarly, to a pre- or post-concert or theater gathering, questions regarding the play, plays in general, concerts, music or the like may also be provided. Furthermore, rather than simply allowing for predetermined subjects, in accordance with the invention, a personalized version of such a plate may be provided. Thus, for example, for a birthday party, anniversary or bridal shower, a user may submit various questions and answers, and the questions and answers may be printed on the top and bottom, respectively, of tabs 125 as noted above. In this manner, these plates could be used to disseminate information about an honored guest or the like.

It is contemplated by the invention to allow a user to log onto a website, enter any number of questions, or question and answer pairs, and have this information printed on plates such as those shown in FIG. 1. This information may also be included on any of the plates in any of the other embodiments depicted below, and the additional products that will now be described. Indeed, a user may select the question material, type of plate, artwork, or any other variables in the product.

Furthermore, while this and the following embodiments describe a plate as the utilitarian object, all of the embodiments of the invention may be applied to any number of other utilitarian objects. For example, these open-ended questions could be printed directly on stacked foods, inserted in preprinted separator wraps between various types of food. These open-ended questions could be printed on tabs or the like, could be provided on stick-on tabs for fruit and produce, and could be printed on deli waxed paper or plastic bags. In addition, a tray liner or place mat shaped object may be employed, such as those often used in fast food restaurants with tabs similarly placed about the outer edge thereof. Also, other types of food containers, such a clamshells or other food encompassing containers may be used, so long as tabs may be fixed along an edge or surface thereof, and open-ended questions, or questions and answers be fixed thereto. Furthermore, such open-end questions for generating conversation could be included on various other food-packaging products to allow for the preparer of such a food to reference this question. This might include on butter tops, milk and orange juice containers, fruit storage containers, frozen milk containers, refrigerated foods, tortillas, tacos, wraps or the like, beverage containers, paper goods, straws, salad dressing bottles, condiment containers or packages, canned goods, soup or pasta containers, snack containers, crackers, cookies, drink or juice boxes, sugar, salt, pepper or sweetener packs, cereal boxes, cocoa, coffee or tea packets, ice cream and yogurt containers, individual dessert containers and the like. Furthermore, these questions could be provided in an interchangeable manner on more permanent fixes for preparing foods such as barbecue grills, microwave ovens or the like. In other areas other than the food distribution, examples may be to provide such questions on a floppy disc, on a rolodex-style card, on a computer screen saver, in a chat room, or for a user to sign up on a mailing list to receive an email including questions each day, or questions specific to the interest and/or profession of a future dinner guest. It may also be provided on a particular LED/LCD readout on an appliance or other appliance, clock radio, or other electronic device, or may be provided specifically as a digital conversation starter, whereby a user through a particular prompt receives an open-ended question. A common factor for all of these alternative embodiments are that an open-ended, thought provoking, opinion-generating question be imparted on a utilitarian object which the user will possess, and therefore the open-ended question is presented to the user without generating an additional burden thereto. In a further alternative embodiment, rather than questions, a story could be told, a different portion thereof, under each tab. Art work or another mechanism would direct the user to the next tab.

Figure 2:
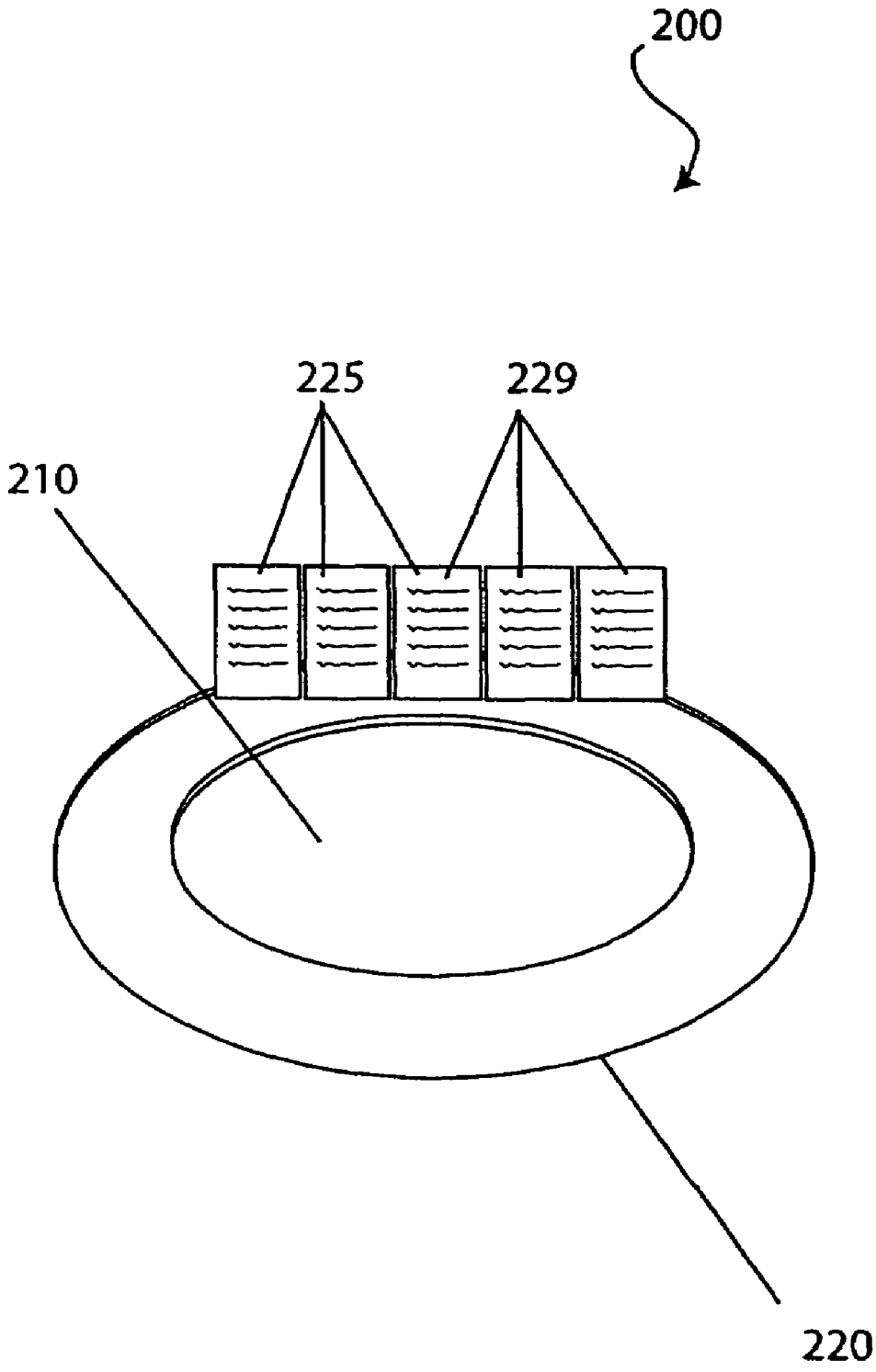
FIG. 2 is a top plan view of a plate with constructions attached thereto constructed in accordance with a second embodiment of the invention.

Referring next to FIG. 2, a second embodiment of the invention is described. As is shown in FIG. 2, a plate 200 made of china, porcelain or other permanent material, or formed of any disposable material, is provided. Plate 200 includes a flat portion 210 for supporting food items or the like, and a curved or raised rim 220 on the outside edge thereof.

Also shown in FIG. 2 are a number of adhesive tabs 225. These tabs may be provided with adhesive fixed thereto, or may be fixed to a utilitarian object through the user of an additional adhesive. While these tabs are not originally provided with plate 200, they may be provided in a stack, and are adapted to be attached to rim 220 of plate 200. Thus, any plate or other utilitarian object may be transformed into an object for generating conversation. Tabs 225 include text material 229 similar to text material 129 of FIG. 1 for assisting in generating conversation. Tabs 225 are attached to plate 200, either hanging over the edge thereof, or fixed completely to rim 220. These tabs may be provided and be removed by a user, thereby providing an answer on the back thereof, or alternatively may be intended to remain on the plates, thereby providing only an open ended opinion-generating question to generate conversation.

It is preferable to provide these tabs 225 made out of a food grade dissolvable material so that the plates may be placed directly in a dishwasher, or hand washed without having to remove the tabs before washing. If the tabs are removed before washing, production using the glue of a food grade dissolvable material will ensure that the glue or other adhesive utilized in with the tabs will cleanly be removed from the plates.

In each of the embodiments depicted in FIGS. 1 and 2, it is also possible to provide the tabs 125 or 225 in a color coded scheme, so that questions that are grouped together are presented on similar color tabs. Thus, questions appropriate for different audiences or ages might be provided on different color tabs. Of course, questions relating to different topics may also be provided with different color tabs. Alternatively, all questions on a plate may be provided with a single color indicating they are all for the same genre and/or class.

Figure 3:
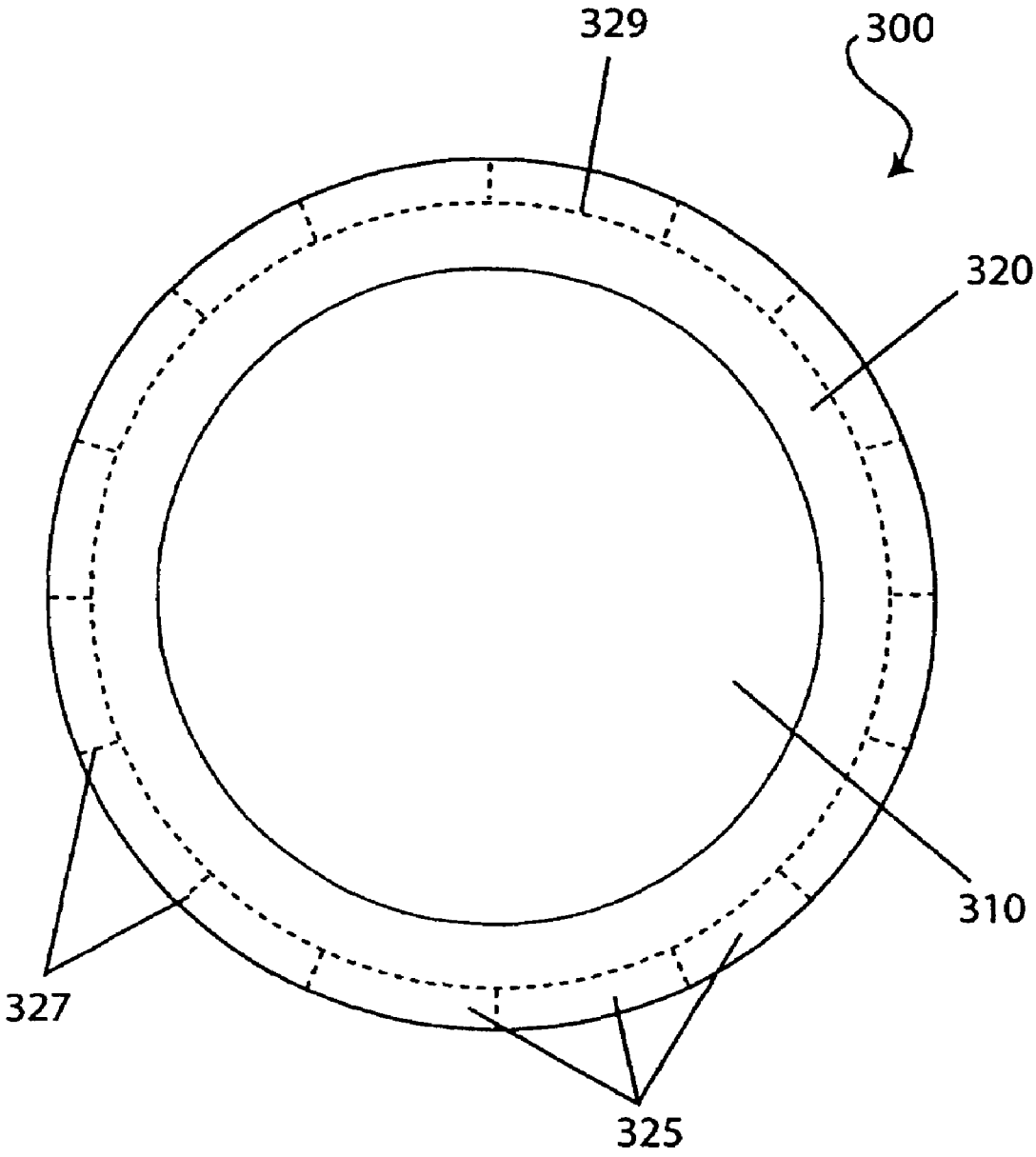
FIG. 3 is a top plan view of a plate constructed in accordance with a third embodiment of the invention.

Furthermore while for example at FIG. 1, perforations are disclosed as taking up the entire rim 120, in accordance with a third embodiment of the invention, perforations 127 may extend over only part of rim 120, and therefore, once all the perforated tabs 125 have been removed, a rim would still be provided around the plate for holding food. Such a design is depicted in FIG. 3. As is shown in FIG. 3, reference numerals 310, 320,325 and 327 correspond to reference numerals 110, 120, 125 and 127 of FIG. 1 and will not be discussed herein. As is further shown in FIG. 3, a circular or coaxial perforation 329 is provided coaxial to the edge of the raised rim 320, and concentric with the plate. As is shown, upon removal of a tab 325 along perforations 327 and 329, a rim will still remain on the plate. It is also true that once all of the tabs have been removed, a rim on the plate will still remain.

Figure 4:
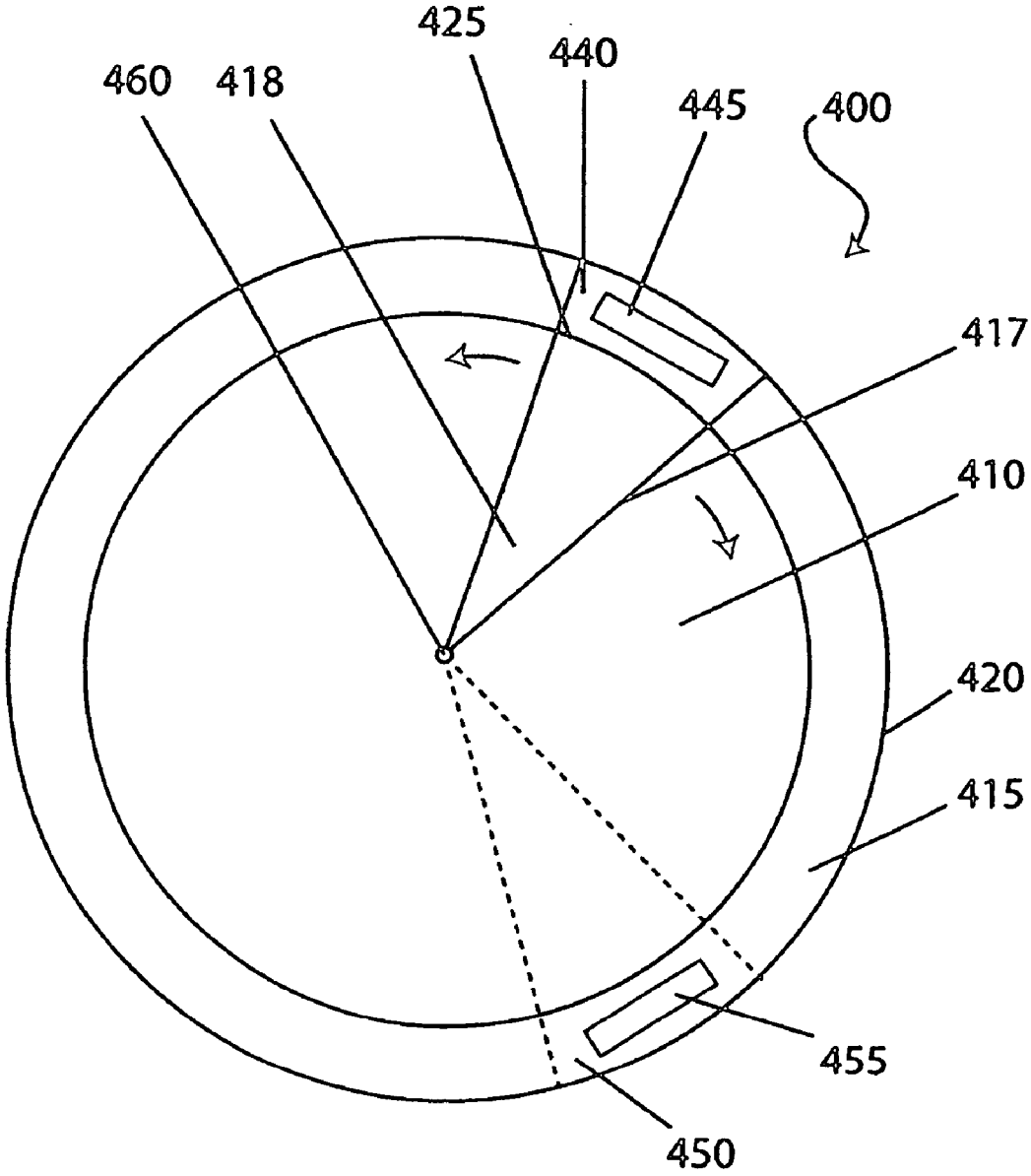
FIG. 4 is a top plan view of a plate constructed in accordance with a fourth embodiment of the invention.

Referring next to FIG. 4, an alternative embodiment of a plate constructed in accordance with a fourth embodiment of the invention is shown. As is shown in FIG. 4, a double platter is provided including an upper circular plate 410 and a lower circular plate 420. Upper circular plate 410 is attached to lower circular plate 420 via a grommet or other attaching mechanism 460 aligned for relative circular movement between upper plate 410 and lower plate 420. Upper plate 410 includes a rim 415 while lower plate 420 includes a rim 425. Rims 415 and 425 are concentric and similarly spaced to each other. Lower plate 420 further comprises various text segments 445, 455 positioned on adjacent portions 440, 450 of rim 425, respectively. As is further shown in FIG. 4, top plate 410 defines an open wedge 417, which allows for the viewing of lower plate 420 therethrough. Open wedge 417 may comprise a missing portion of upper plate 410, or may preferably comprise a window 418 allowing for the viewing of lower plate 420 therethrough while supporting any food or liquid thereon. Thus, no food could pass through upper plate 410 to lower plate 420. Upon the rotation of plate 410 relative to plate 420, defined opening (or window) 417 is moved to a position to allow the display of a previously covered text portion 445 along associated rim portion 440 of rim 425. As is also shown, upon the viewing of text portion 445, text portion 455 is hidden from view under top plate 420 because defined space 417 only allows the viewing of text portion 445. As is clear from FIG. 4, upon the rotation of plate 420, defined space 417 may be moved to reveal any one of the predefined text segments. While only two text segments and one defined opening 417 are depicted in FIG. 4, any number of text segments and defined openings may be provided along rim 425 of lower plate 420. If more than one opening is provided, it is possible to provide a question displayed in one opening while an answer to the question displayed in the other opening.

The text portions included in this plate may comprise questions and answers, and preferably comprise open-ended comments or questions asking for an opinion such as those described with respect to FIG. 1. Therefore, in a manner similar to the prior embodiments, such a plate would allow for the generation of conversation during a gathering.

Figure 5:
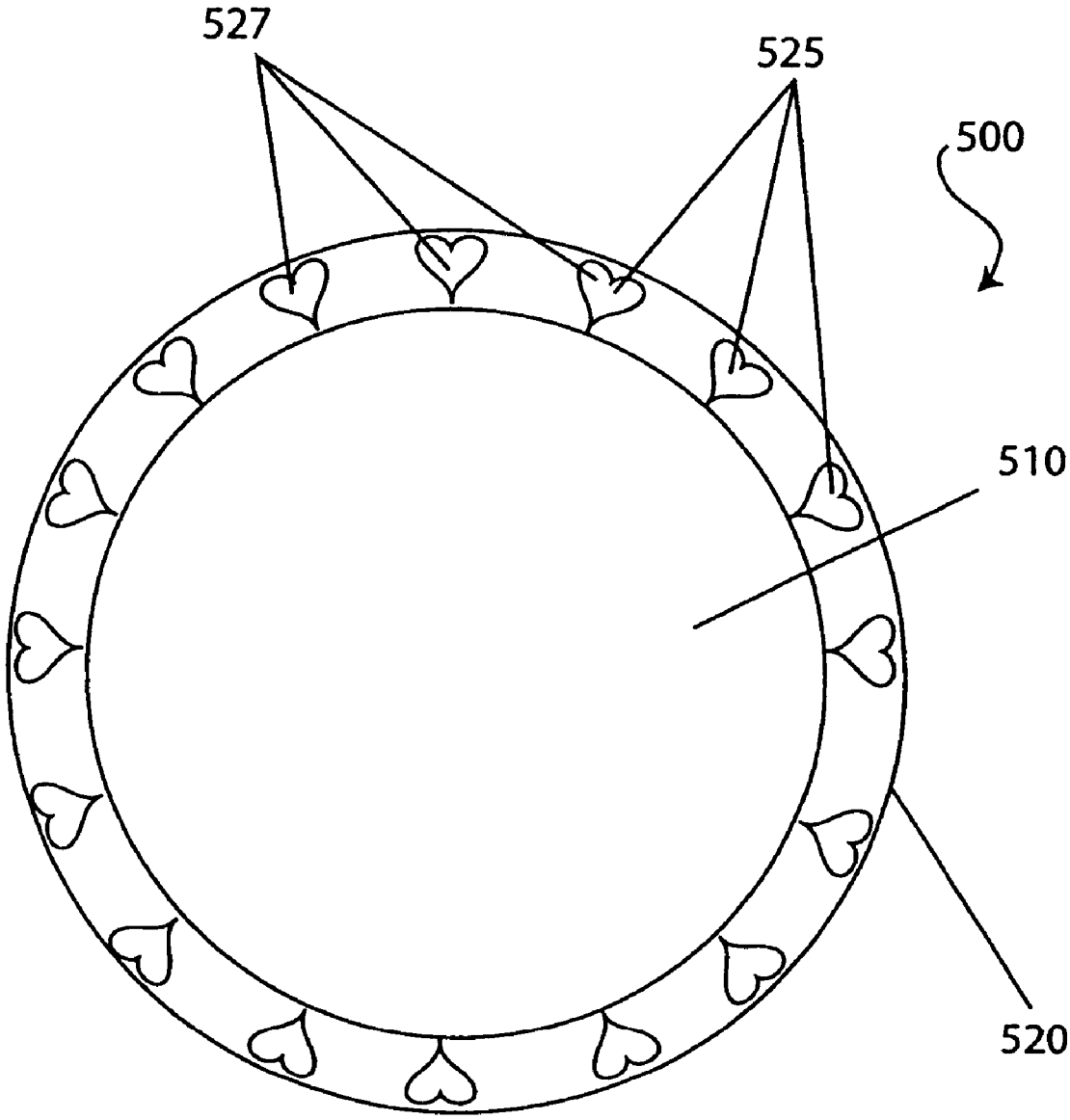
FIG. 5 is a top plan view of a plate constructed in accordance with a fifth embodiment of the invention.

Referring next to FIG. 5, an additional alternative embodiment constructed in accordance with a fifth embodiment of the invention is shown. In FIG. 5, rather than providing perforations 127 and tabs 125 in a square or a trapezoidal shape, a plate 500 is provided with a flat portion 510, a rim 520, and tab portions 525. In FIG. 5, these tab portions are shaped as hearts but may be shaped in any manner as desired. Depending on the material, these shapes may be perforated, dye cut or the like. The common feature among them is that they may be pushed through along a cut or perforated edge 527. Thus, a plate is provided that is more decorative, and, even once perforated portions are removed therefrom, the outer edge of the plate remains the same in diameter and circumference. As in all prior embodiments, while questions and answers may be provided on opposite sides of each tab portion 525, in a preferred embodiment, open-ended questions asking for an opinion are provided on perforated portions 525, similar to text 129 provided with respect to FIG. 1. In this additional manner, conversation may be generated in a gathering of people.

Figure 6:
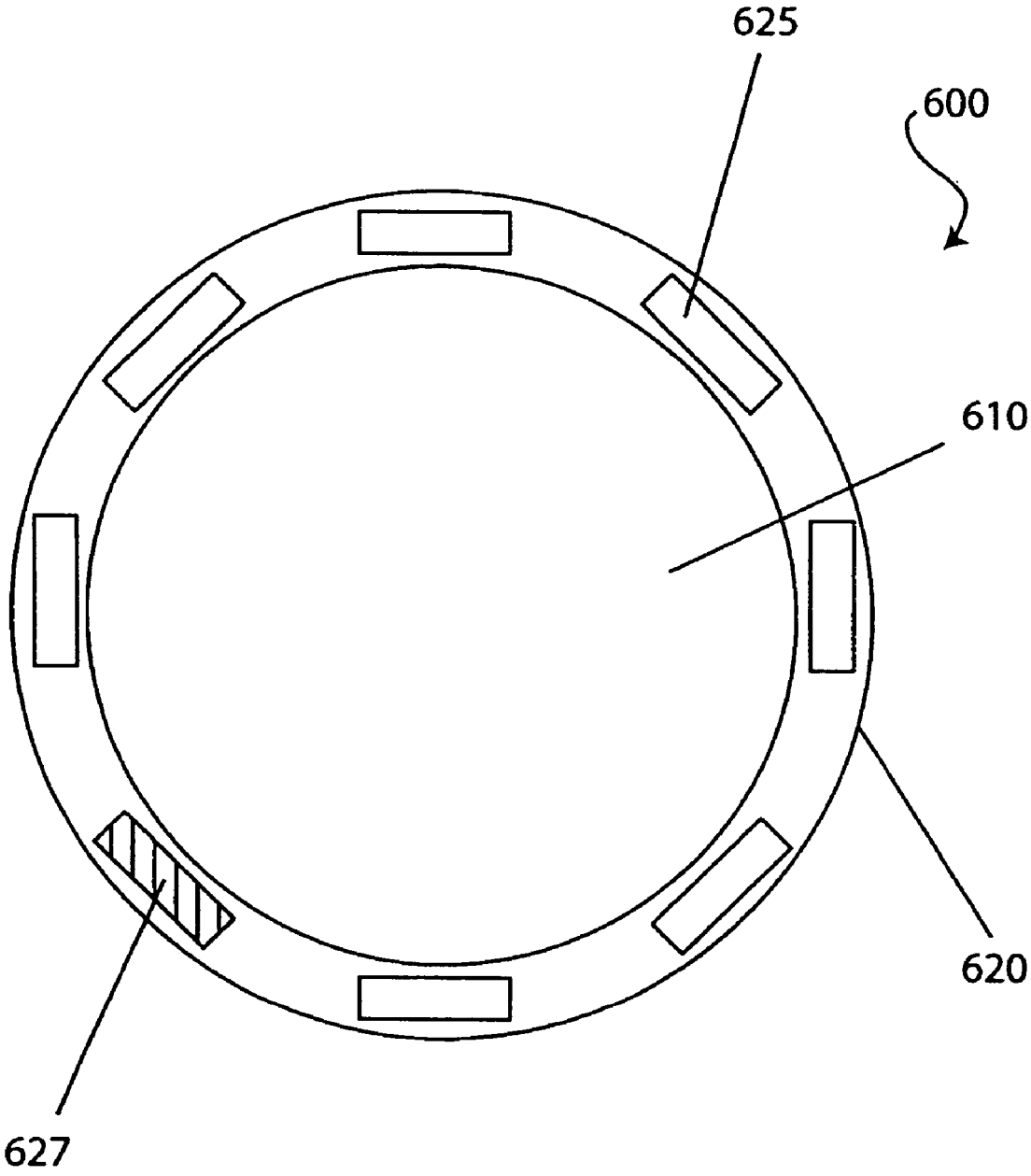
FIG. 6 is a top plan view of a plate constructed in accordance with a sixth embodiment of the invention.

Referring next to FIG. 6, an additional alternative embodiment constructed in accordance with a sixth embodiment of the invention is shown. A plate 600 includes a base 610, and rim 620 including covered tabs 625. These tabs 625 may be peeled off, if constructed of lightly coated adhesive strips, or may be scratched off utilizing standard well-known scratch-off techniques. Text 629 is included underneath the tabs 625, including contents similar to that of text 129 described with reference to FIG. 1. In this additional embodiment, it is possible to provide a conversation generator on a plate without requiring a user to disrupt the structure of the plate.

Figure 7:
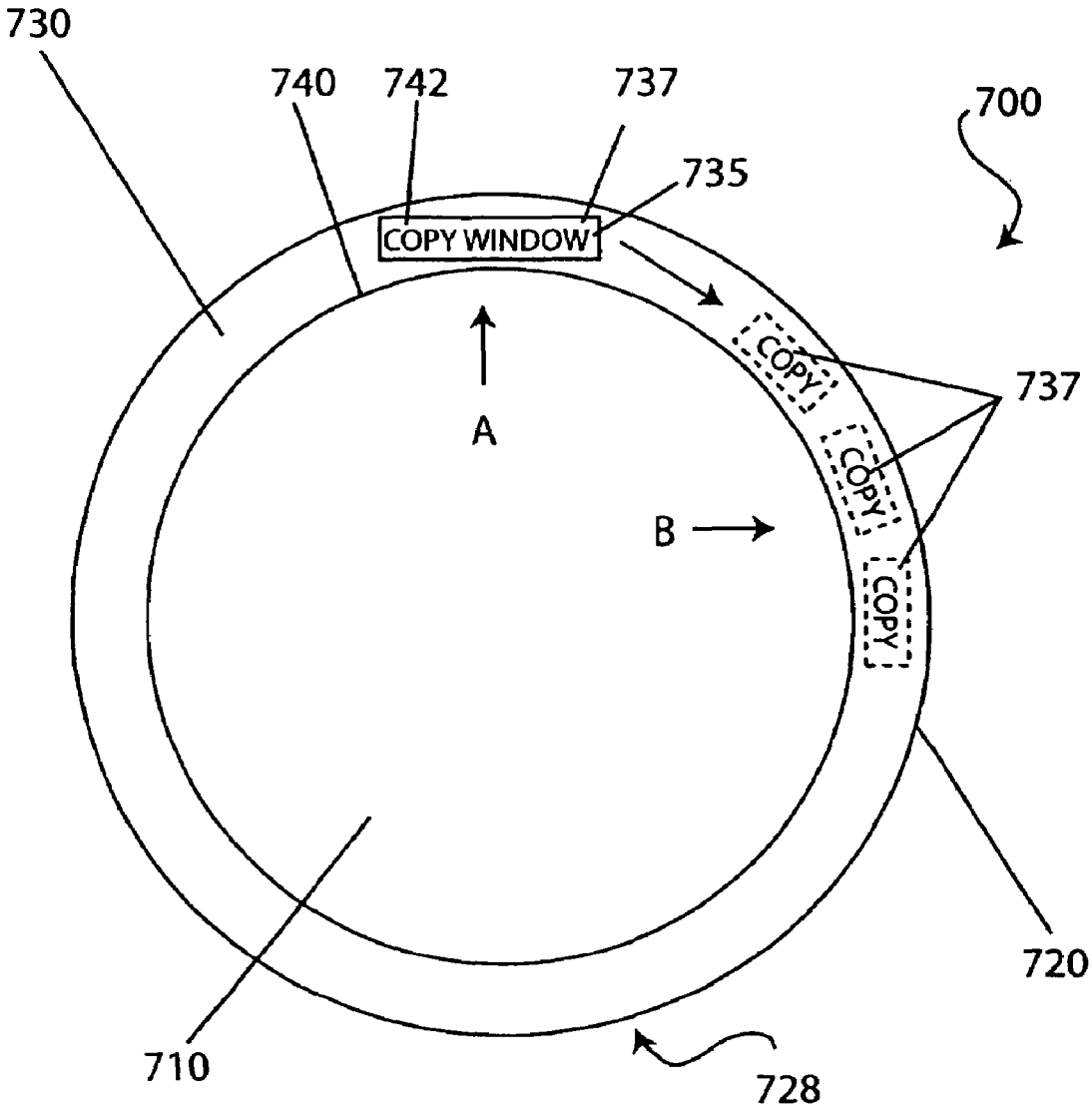
FIG. 7 is a top plan view of a plate constructed in accordance with a seventh embodiment of the invention.
Figure 8:
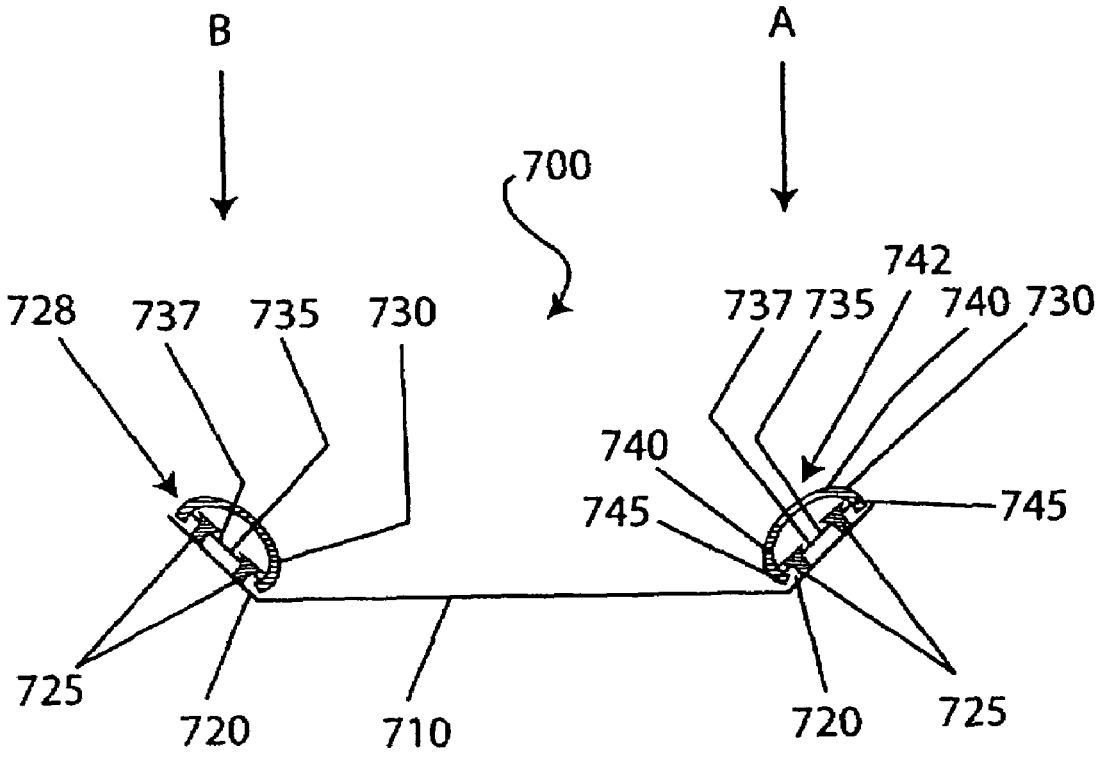
FIG. 8 is a cross-sectional view of the plate of FIG. 7.

Referring next to FIGS. 7-9, further embodiments of the invention will now be described. As is shown in FIGS. 7 and 8, a plate 700 is provided with a bottom flat surface 710 for placing food, and raised side rim surfaces 720. A double circular ring 728 is provided including an upper circular ring 730 and a lower circular ring 735. Lower circular ring 735 is attached to raised side surfaces 720 via stoppers 725. Stoppers 725 are fixed to raised side surfaces 720 of plate 700 via an appropriate adhesive that may be removed so that these stoppers may be selectively fixed to any plate. This configuration would be employed when it is desired to fix such a double circular ring 728 to china or other dinner plate that does not typically include such rings. Alternatively, stoppers 725 may be permanently fixed to, or formed integral with raised side surfaces 720. This configuration would be employed when plate 700 was specifically designed to receive such a double circular ring 728, but it is desired to use plate 700 multiple times with different double circular rings. In either configuration, stoppers may comprise a plurality of individual stoppers positioned about rim 720 in a concentric manner. Alternatively, stoppers 725 may be provided as concentric circular rings having a cross-section as shown in FIG. 8. In this alternative embodiment, positioning of the stoppers might be easier, and a larger surface of contact exists between stoppers 725 and double circular ring 728. In either alternative configuration stoppers 725 are adapted to allow for the attachment or removal of various double circular rings 728, thereby allowing for use with any number of question sets, as will be further described below.

In either configuration of stoppers 725, upper circular ring 730 is attached to lower circular ring 735 via sliding attachment arms or other sliding attaching mechanism 745 aligned for relative circular movement between upper circular ring 730 and lower circular ring 735. Lower circular ring 735 does not move relative to stoppers 725. Thus, upper circular ring 730 encloses lower circular ring 735. Circular rings 730 and 735 are concentric and similarly spaced to each other. Lower circular ring 735 further comprises various text segments 737 positioned thereon as shown in FIG. 7. As is further shown in area A of FIGS. 7 and 8, extending portions 740 of top circular ring 730 define a window 742, which allows for the viewing of lower circular ring 735 therethrough. Additionally, in area B, no window is defined and therefore text segments 737 on lower circular ring 735 are hidden from view by upper circular ring 730.

Upon the rotation of upper circular ring 730 relative to lower circular ring 735 defined opening 742 is moved to a position to allow the display of a previously covered text portion 737 along lower circular ring 735. As is also shown, upon the allowance of viewing of one text portion 737, all other text portions 737 are hidden from view under upper circular ring 730 because defined space 742 does not allow the viewing thereof. As is clear from FIG. 7, upon the rotation of upper circular ring 730, defined space 742 may be moved to reveal any one of the predefined text segments. While only one defined opening 742 is depicted in FIG. 7, any number of text segments and defined openings may be provided along upper and lower circular rings 730 and 735. If two defined opening are provided, a question may be viewed through one defined opening while the corresponding answer top the question may be viewed through the other defined opening.

The text portions included in this plate may comprise questions and answers, and preferably comprise open-ended comments, questions asking for an opinion such as those described with respect to FIG. 1. Therefore, in a manner similar to the prior embodiments, such a plate would allow for the generation of conversation during a gathering.

Figure 9A:
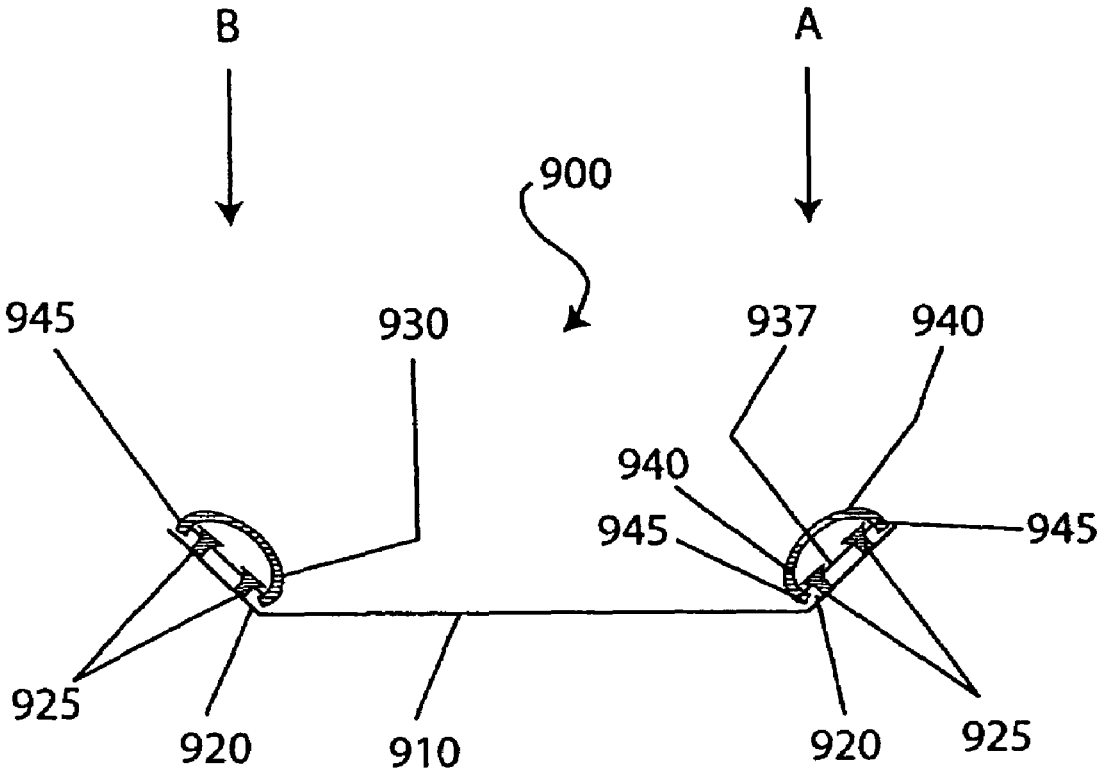
FIG. 9A is a cross-sectional view of an alternative embodiment of the plate of FIGS. 7 and 8.

In a further embodiment shown in FIG. 9A, rather than providing text portions 737 on lower circular ring 735, no lower circular ring is provided. Thus, as is shown in FIG. 9A, a plate 900 is provided with a bottom flat surface 910 for placing food, and raised side surfaces 920. A circular ring 930 is provided. Circular ring 930 is rotatably attached to raised side rim surfaces 920 via stoppers 925. Stoppers 925 are permanently fixed to raised side rim surfaces 920. Circular ring 930 is rotatably attached to stoppers 925 via sliding attachment arms or other sliding attaching mechanism 945 aligned for relative circular movement between circular ring 930 and raised sides 920 of plate 900. This configuration would be employed when plate 900 was specifically designed to receive such a circular ring 930. Stoppers 925 are adapted to allow for the attachment or removal of circular ring 930, thereby allowing for use of circular ring 930 with any number of plates 900, and thus question sets, as will be further described below.

Upper circular ring 930 hides rim 920. Circular ring 930 is concentric to rim 920. Rim 920 further comprises various text segments 937 positioned thereon, similar to the positioning of text portions 737 positioned on lower circular ring 735 shown in FIG. 7. As is further shown in area A of FIG. 9A, extending portions 940 of circular ring 930 define a window 942, which allows for the viewing of rim 920 therethrough. Additionally, in area B, no window is defined and therefore text segments 937 on rim 920 are hidden from view by circular ring 930. Upon the rotation of circular ring 930 relative to rim 920, defined opening 942 is moved to a position to allow the display of a previously covered text portion 937 along rim 920. As is also shown, upon the allowance of viewing of one text portion 937, all other text portions 937 are hidden from view under circular ring 930 because defined space 942 does not allow the viewing thereof. Similar to the embodiment depicted in FIG. 7, upon the rotation of circular ring 930, opening 942 may be moved to reveal any one of a plurality of predefined text segments. While only one defined opening 942 is depicted in FIG. 9A, any number of text segments and defined openings may be provided along rim 920.

The text portions included in this plate may comprise questions and answers, and preferably comprise open-ended comments, questions asking for an opinion such as those described with respect to FIG. 1. Therefore, in a manner similar to the prior embodiments, such a plate would allow for the generation of conversation during a gathering.

Figure 9B:
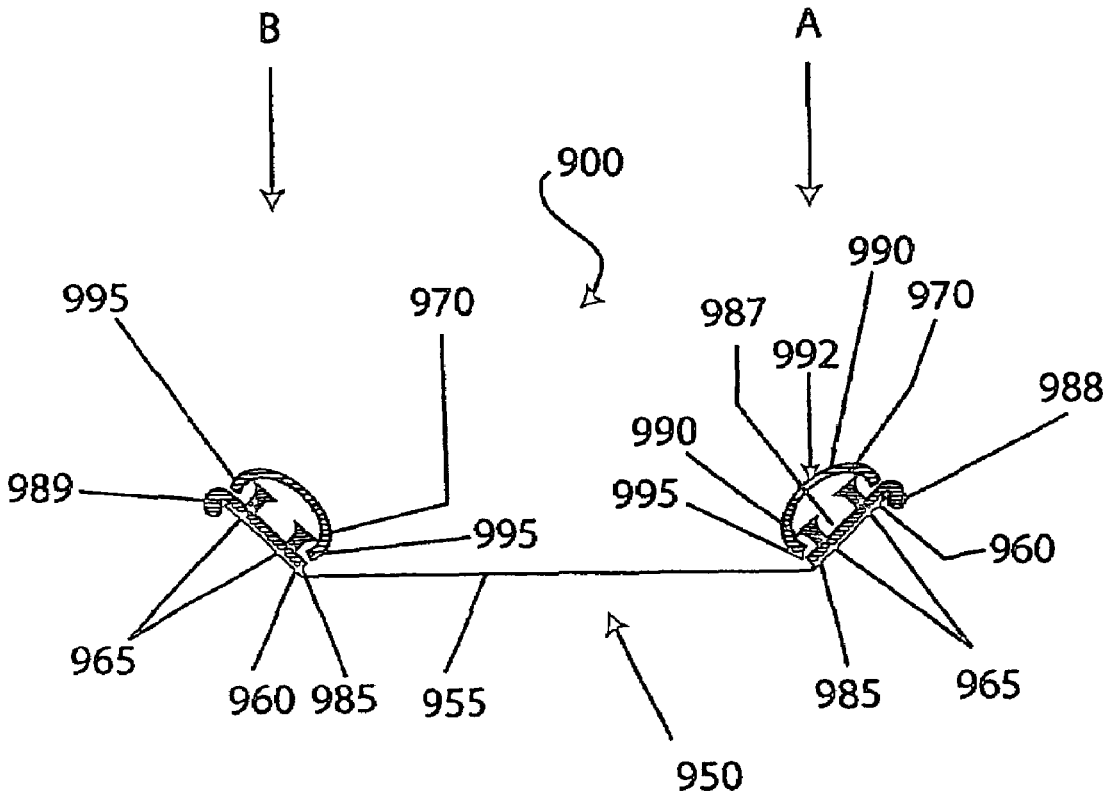
FIG. 9B is a cross-sectional view of an alternative embodiment of the plate of FIGS. 7 and 8.

In a further embodiment shown in FIG. 9B, rather than providing stoppers for fixing a lower circular ring to the rim of the plate, a lip is provided for attaching the lower circular ring to the plate. Thus, as is shown in FIG. 9B, a plate 950 is provided with a bottom flat surface 955 for placing food, and raised side surfaces 960. A lower circular ring 985 and an upper circular ring 970 are provided. Lower circular ring 985 is fixedly attached to raised side rim surfaces 960 via a lip 988 of lower circular ring 985 engaging raised side rim surfaces 960. Thus, lower circular rim 985 will not move relative to plate 950. Stoppers 965 are permanently fixed to lower circular ring 985. Upper circular ring 970 is rotatably attached to stoppers 965 via sliding attachment arms or other sliding attaching mechanism 995 aligned for relative circular movement between upper circular ring 970 and lower circular ring 985. Stoppers 965 are adapted to allow for the attachment or removal of upper circular ring 970, thereby allowing for use of upper circular ring 970 with any number of lower circular rings 985, and thereby, any number of plates 950. Furthermore, lower circular ring 985 is adapted to be selectively removable from plate 950, and be used with any number thereof.

Lower circular ring 985 hides rim 960. Upper circular ring 970 is concentric to lower circular ring 985. Lower circular ring 985 further comprises various text segments 987 positioned thereon, similar to the positioning of text portions 737 positioned on lower circular ring 735 shown in FIG. 7. As is further shown in area A of FIG. 9B, extending portions 990 of upper circular ring 970 define a window 992, which allows for the viewing of lower circular ring 985 therethrough. Additionally, in area B, no window is defined and therefore text segments 987 on lower circular ring 985 are hidden from view by upper circular ring 970. Upon the rotation of upper circular ring 970 relative to lower circular ring 985, defined opening 992 is moved to a position to allow the display of a previously covered text portion 987 along lower circular ring 985. As is also shown, upon the allowance of viewing of one text portion 987, all other text portions 987 are hidden from view under upper circular ring 970 because defined space 992 does not allow the viewing thereof. Similar to the embodiment depicted in FIG. 7, upon the rotation of upper circular ring 970, opening 992 may be moved to reveal any one of a plurality of predefined text segments. While only one defined opening 992 is depicted in FIG. 9B, any number of text segments and defined openings may be provided along rim 960.

The text portions included in this plate may comprise questions and answers, and preferably comprise open-ended comments, questions asking for an opinion such as those described with respect to FIG. 1. Therefore, in a manner similar to the prior embodiments, such a plate would allow for the generation of conversation during a gathering.

Figure 9C:
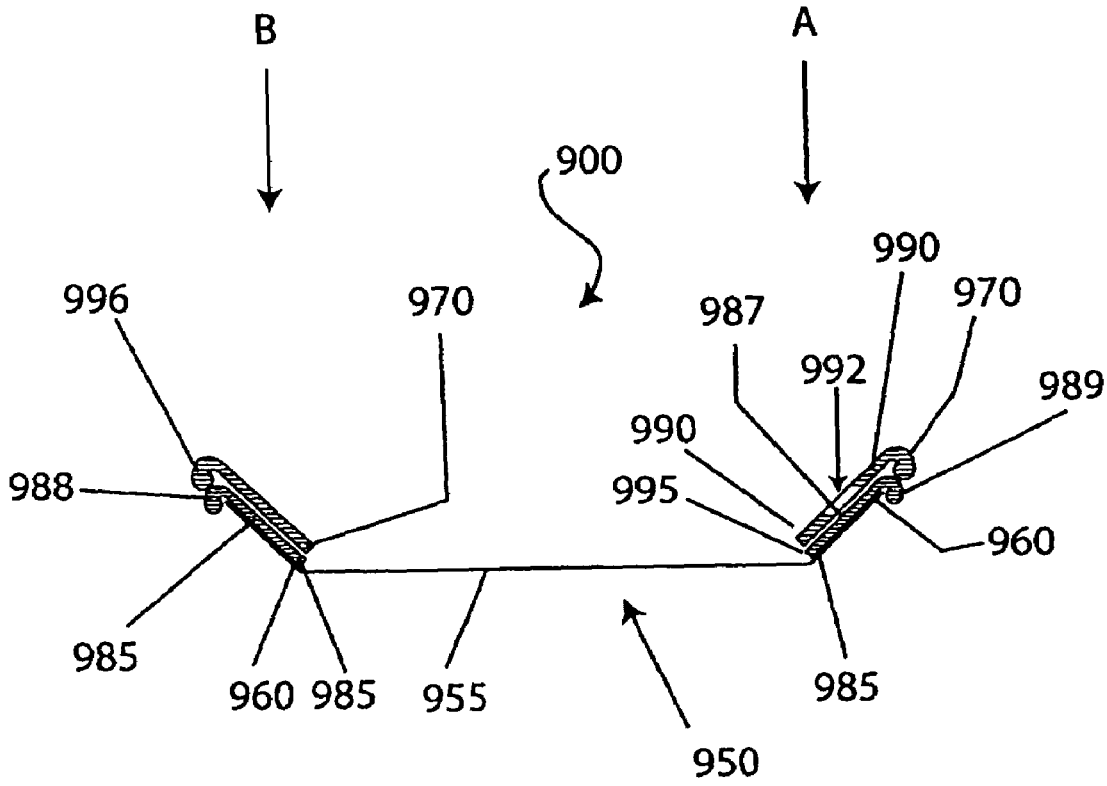
FIG. 9C is a cross-sectional view of an alternative embodiment of the plate of FIGS. 7 and 8.

In a further embodiment shown in FIG. 9C, rather than providing stoppers for fixing the upper circular ring to the lower circular ring, a lip is provided for attaching the upper circular ring to lower circular ring. Thus, as is shown in FIG. 9C, a plate 950 is provided with a bottom flat surface 955 for placing food, and raised side surfaces 960. A lower circular ring 985 and an upper circular ring 970 are provided. Lower circular ring 985 is fixedly attached to raised side rim surfaces 960 via a lip 988 of lower circular ring 985 engaging raised side rim surfaces 960. Thus, lower circular rim 985 will not move relative to plate 950. Upper circular ring 970 is rotatably attached lower circular ring 985 via sliding attachment arms or other sliding attaching mechanism 996 aligned for relative circular movement between upper circular ring 970 and lower circular ring 985. Sliding attachment arms 996 are adapted to allow for the attachment or removal of upper circular ring 970, thereby allowing for use of upper circular ring 970 with any number of lower circular rings 985, and thereby, any number of plates 950. Furthermore, lower circular ring 985 is adapted to be selectively removable from plate 950, and be used with any number thereof.

Lower circular ring 985 hides rim 960. Upper circular ring 970 is concentric to lower circular ring 985. Lower circular ring 985 further comprises various text segments 987 positioned thereon, similar to the positioning of text portions 737 positioned on lower circular ring 735 shown in FIG. 7. As is further shown in area A of FIG. 9C, extending portions 990 of upper circular ring 970 define a window 992, which allows for the viewing of lower circular ring 985 therethrough. Additionally, in area B, no window is defined and therefore text segments 987 on lower circular ring 985 are hidden from view by upper circular ring 970. Upon the rotation of upper circular ring 970 relative to lower circular ring 985, defined opening 992 is moved to a position to allow the display of a previously covered text portion 987 along lower circular ring 985. As is also shown, upon the allowance of viewing of one text portion 987, all other text portions 987 are hidden from view under upper circular ring 970 because defined space 992 does not allow the viewing thereof. Similar to the embodiment depicted in FIG. 7, upon the rotation of upper circular ring 970, opening 992 may be moved to reveal any one of a plurality of predefined text segments. While only one defined opening 992 is depicted in FIG. 9C, any number of text segments and defined openings may be provided along rim 926.

Other attachment schemes, such as a tongue and groove engagement, may be employed that allow for the relative movement between an upper and lower ring.

The text portions included in this plate may comprise questions and answers, and preferably comprise open-ended comments, questions asking for an opinion such as those described with respect to FIG. 1. Therefore, in a manner similar to the prior embodiments, such a plate would allow for the generation of conversation during a gathering.

Figure 10A:
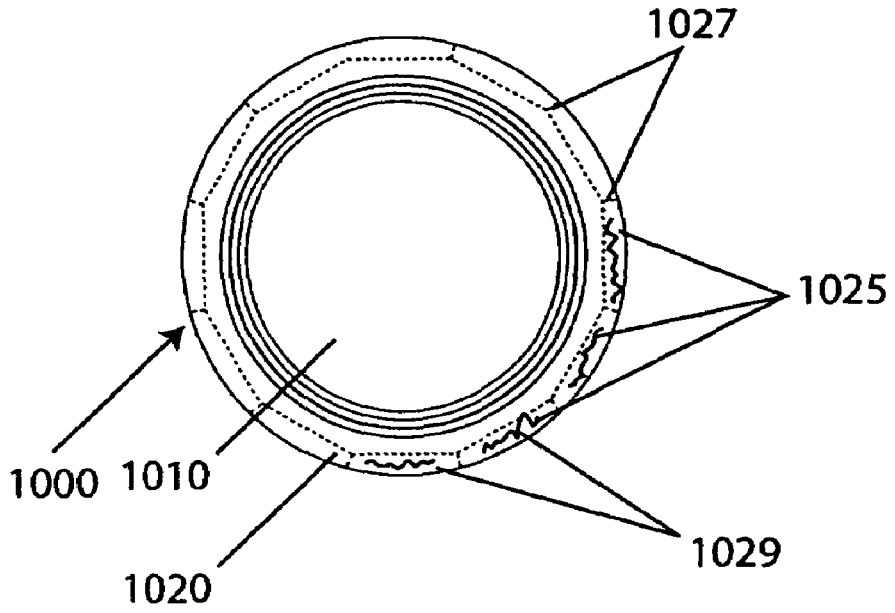
FIG 10A is a top plan view of a plate constructed in accordance with an eighth embodiment of the invention.

Referring next to FIGS. 10A-10F, an additional embodiment constructed in accordance with an eighth embodiment of the invention will now be described. As is shown in FIG. 10A, a plate 1000 is provided including a flat portion 1010 for holding food, and a circular rim 1020. Plate 1000 further comprises a plurality of tabs 1025 folded underneath circular rim 1020. A plurality of perforations 1027 are provided defining each tab 1025. As is further shown in FIG. 10, text material 1029 is written on a portion of rim 1020 corresponding to each of these tabs 1025. The tabs are designed so that they may be selectively and individually folded from under rim 1020 to reveal an answer or other phrase associated to a corresponding text material 1029. Perforations 1027 may be provided in a circular configuration as shown in FIG. 10A, or in a multi-sided configuration as shown in FIG. 10G The configuration in FIG. 10G allows for easier folding of each of tabs 1025. The following description is made referring to the configuration shown in FIG. 10A, but would apply equally to the configuration shown in FIG. 10G. In a preferred embodiment, a question or the like is provided as text material 1029 on the visible portion of rim 1020, and each corresponding tab 1025 includes an answer to the noted question, if the question is one that lends itself to an answer.

Figure 10B:
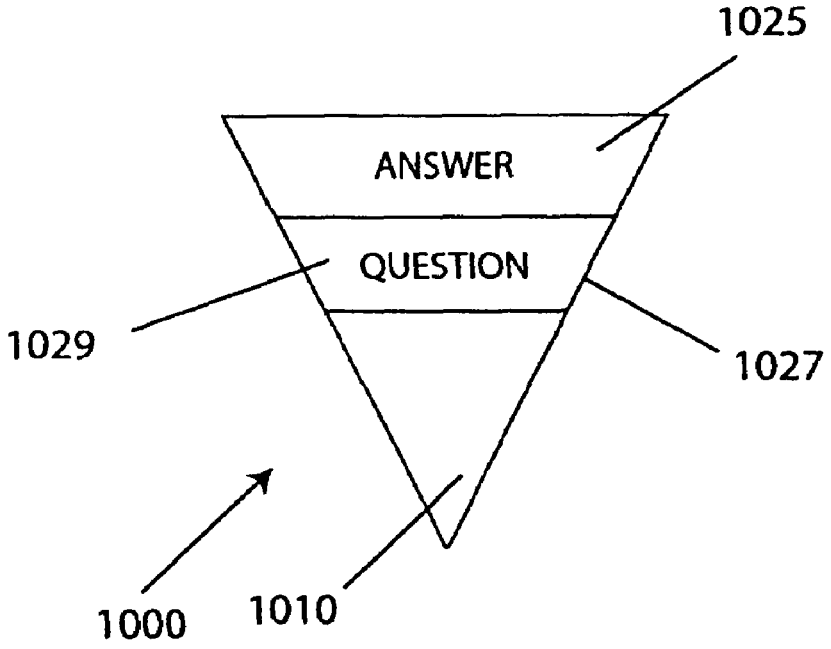
FIG. 10B is a top plan view of a portion of the plate of FIG. 10A.
Figure 10C:
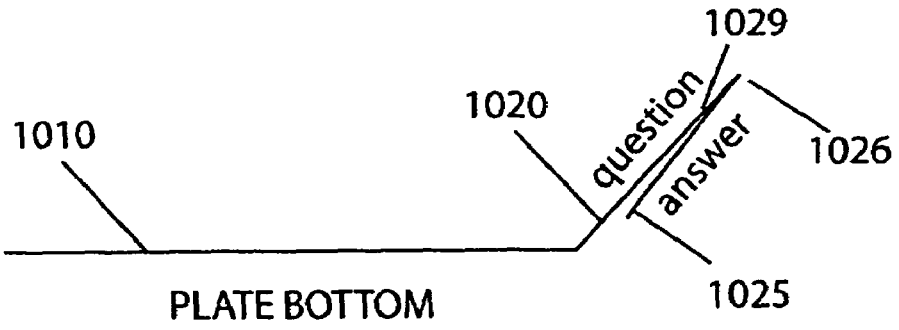
FIGS. 10C-10F depict the functioning of the plate of FIGS. 10A and 10B.
Figure 10D:
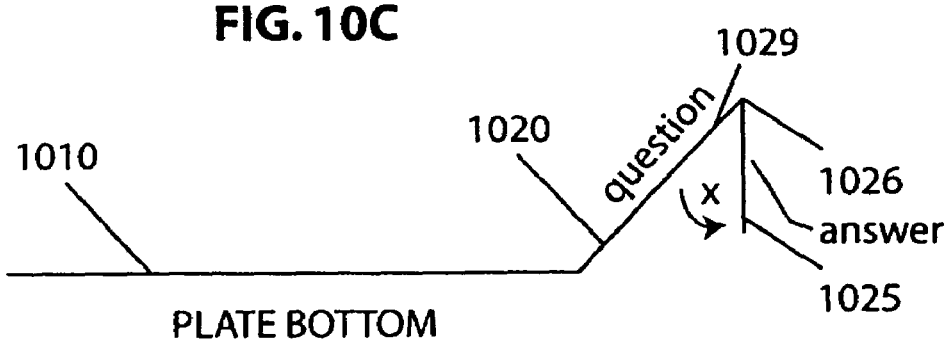
Figure 10E:
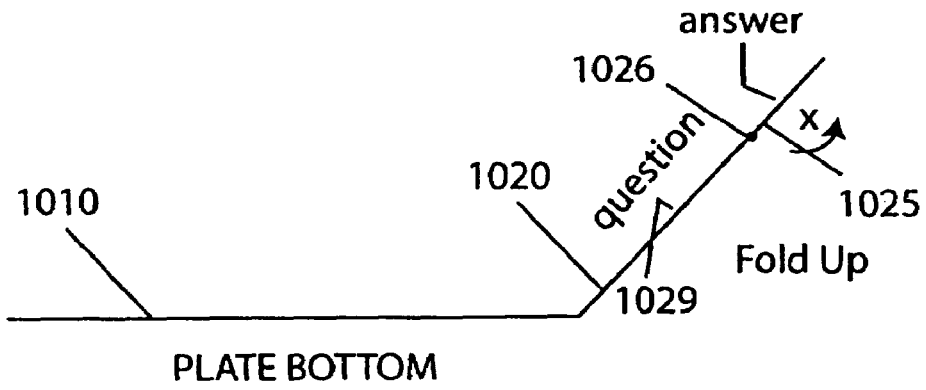
Figure 10F:
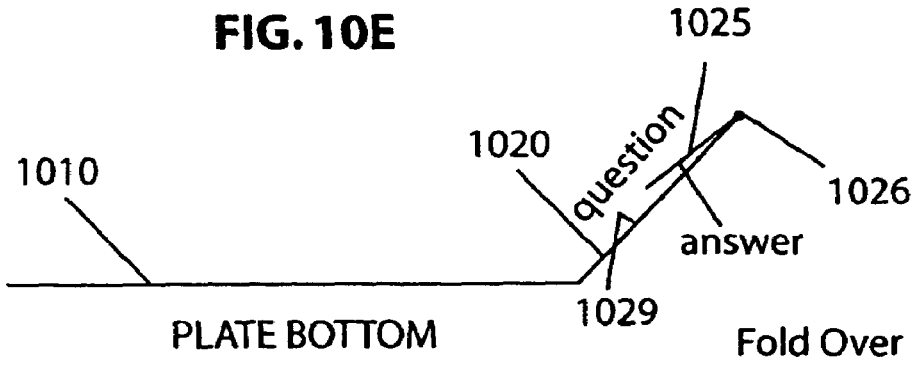
Figure 10G:
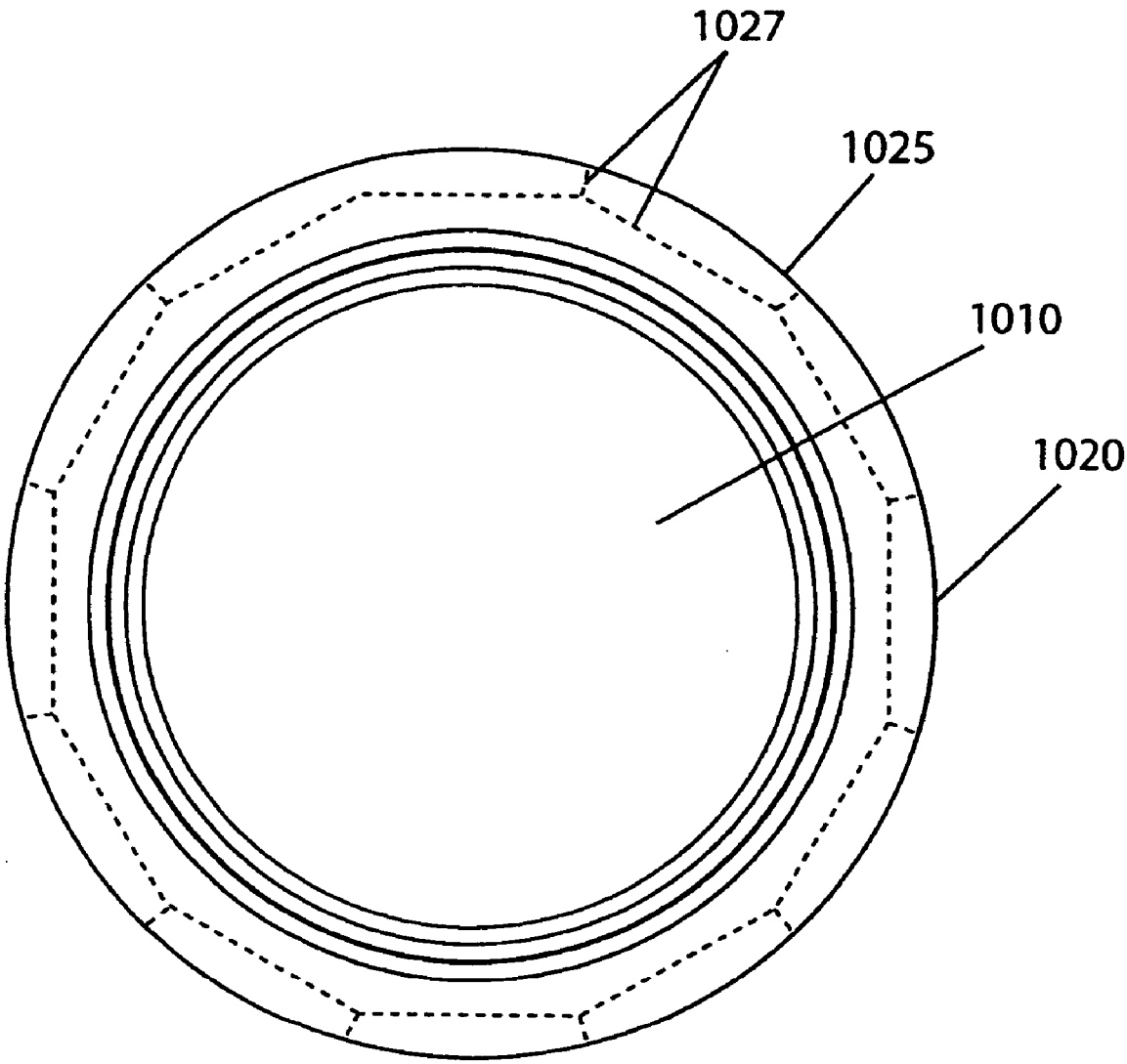
FIG. 10G is a top plan view of an alternative embodiment of the plate of FIG. 10A constructed in accordance with the invention.

Thus, each question and answer pair is provided on a portion of plate 1000 depicted in FIG. 10B. In FIG. 10C, a cross-section of part of the plate is shown. In this cross-section, tab 1025 is temporarily attached to the underside of rim 1020 by an adhesive, and is permanently hinged to rim 1020 via a connecting portion 1026. If a plate is constructed with each tab shaped as a wedge, upon the folding of the tab under the plate, the edges of the plurality of tabs 1025 would overlap each other. This may be appropriate, or otherwise tabs 1025 may be trimmed so that they do not overlap each other. After a particular question of text material 1029 is read from rim 1020, the adhesion holding a corresponding tab 1025 to the underside or rim 1020 is broken, and tab 1025 is rotated about hinges portion 1026, as is shown in FIG. 10D. Tab 1025 continues its rotation in FIG. 10E until it is positioned substantially coplanar with rim 1020. In this position it is possible to read the answer corresponding to the read question from tab 1025. After reading this answer, tab 1025 continues through its rotation about connecting portion 1026 until tab 1025 is positioned adjacent the top surface of rim 1020, where it is fixed as shown in FIG. 10F. A design or other text may be provided at location X in FIG. 10F so that a user may continue to have a pleasant and interesting viewing surface even after a particular question and answer pair has been explored. Additionally, a topic or the like (word, color, etc. may be placed at location 1029 with an open-ended question, statement or the like may be placed at location 1025. If an answer is appropriate, the answer may be placed at location X of FIGS. 10D-10F. The operation of such a plate is the same as that shown above.

The text portions included in this plate may comprise questions and answers, and preferably comprise open-ended comments, questions asking for an opinion such as those described with respect to FIG. 1. Therefore, in a manner similar to the prior embodiments, such a plate would allow for the generation of conversation during a gathering.

In all of the prior embodiments, text including a question and answer pair have been depicted a residing on opposite sides of a single tab, where appropriate. However, it is within the scope of the invention that a question is presented on one tab and an answer on another tab on the same plate, or even on a tab on another plate. Color-coding or the like might be provided to allow two users to match a question with an answer. In this manner, interaction between various users is increased because another person must be consulted in order to obtain an answer to any particular presented question.

Figure 11:
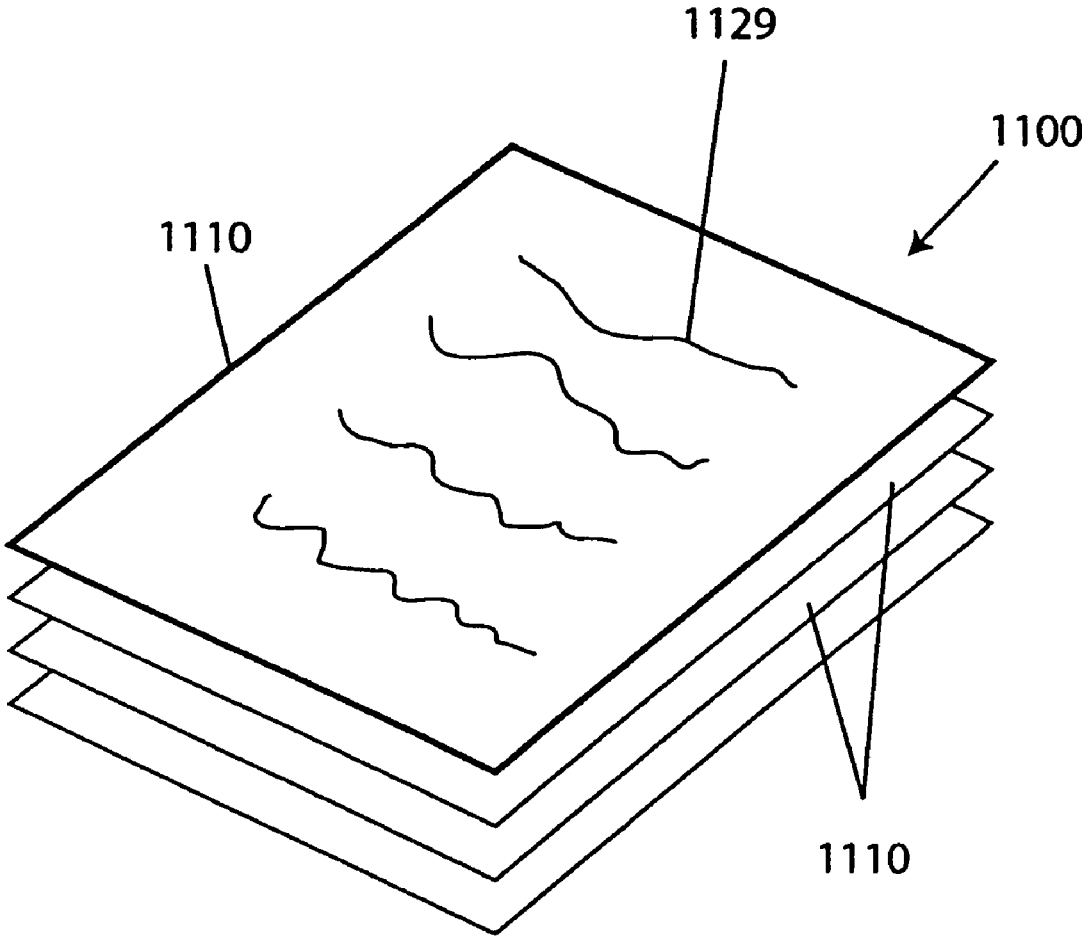
FIG. 11 is a perspective view of a plurality of adhesive tabs constructed in accordance with a ninth embodiment of the invention.

All of the prior embodiments have included plates as the basic utilitarian structure. However, the use of plates as the utilitarian structure is not necessary. Specifically, in accordance with a ninth embodiment of the invention, as is shown in FIG. 11, a stack or plurality of adhesive tabs 1100 is provided. Each of these adhesive tabs includes text 1129 similar to text 129 of FIG. 1, and includes alight adhesive on the side of each tab 110 opposite from text 1129. Thus, a user may employ these tabs as depicted in FIG. 2, wherein these tabs are affixed to a plate. However, these tabs may also be employed prefixed to any other utilitarian object allowing for the use of the utilitarian object and to aid in conversation generation. Therefore, these tabs may be affixed to cups, plates, napkins, utensils, glasses, place mats, and various fixed objects such as walls, windows, chairs, a bar, or the like. In this manner, it is not necessary to predetermine a particular utilitarian object that will include the thought provoking and opinion/conversation generating statements, rather they can be placed anywhere by a user. Furthermore, in this type of preprinted arrangement, it is more possible to provide a customized set of questions, thereby allowing a user to perhaps select one or more questions from a large question databank, and thereby receiving a predetermined desirable question rather than random questions provided by a manufacturer. Furthermore, a user could provide any number of desired questions, and have these questions placed on tabs 1110. Thus a user can customize the questions for a particular occasion, or for any other reason.

Figure 12:
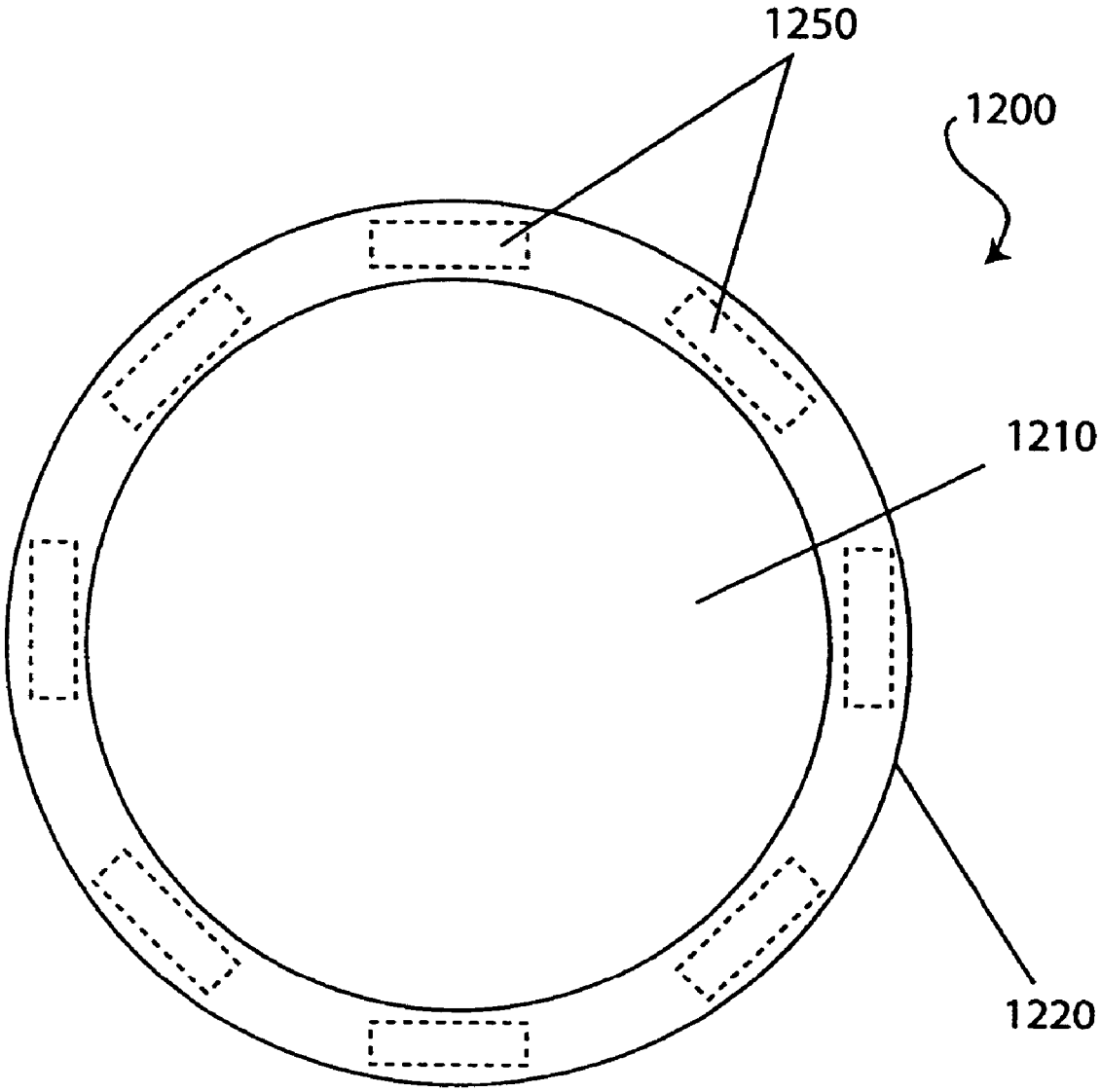
FIG. 12 is a top plan view of a plate constructed in accordance with a tenth embodiment of the invention.

Referring next to FIG. 12, a further embodiment constructed in accordance with a tenth embodiment of the invention will now be described. In this additional embodiment a plate 1200 is provided with a flat portion 1210 for holding food and a rim 1220. Embedded within plate 1200, preferably within rim 1220 are one or more microchips 1230. Each microchip is preprogrammed with a question and/or answer if appropriate. Artwork or other indicator of genre, topic or the like may be provided on a portion of rim 1220 corresponding to the location of each microchip. This artwork preferably informs a user of the topic or genre of the question that will be asked upon actuation of each corresponding microchip. Actuation may be performed in any known manner, including through the application of heat, light, or a signal from an actuator unit, but is preferably performed by pressure imparted to a particular microchip. Upon recognition of such an actuation pressure, the particular actuated microchip audibly outputs a question, and/or answer when appropriate.

While single plate operation has been described, a multiple plate operation may also be employed, as will now be described making reference to FIG. 13. In accordance with such a plate constructed in accordance with an eleventh embodiment of the invention, a user obtains a plate 1300 including a flat portion 1310 for holding food and a rim 1320. One or more microchips 1330 are embedded in plate 1300, and preferably in rim 1320. A user actuates one microchip indicative of one particular topic of interest to the user. Artwork labels or the like may be provided adjacent each microchip 1330 to indicate the topic of the particular microchip. The actuated microchip then remains active, and transmits an indication of the designated genre/topic via a transmission antenna 1340. At the same time, via a receiver antenna 1350, the plate receives transmitted genre/topic information from other plates. When the user's plate encounters another plate having the same genre/topic indicated, a notification signal is emitted from the active microchip on each plate. After coupling in this manner, a question is emitted from one of the microchips for discussion between the users of the coupled plates. The other of the coupled plates may give the answer to the asked question, if appropriate. The other plate may then ask the next question. In this manner, users with similar interest may be joined before topics are discussed. Alternatively, these microchips could combine to tell consecutive portions of a story or any other monologue. Artwork on the plate would indicate proper sequence, or the microchips would automatically recognize the order.

Figure 13:
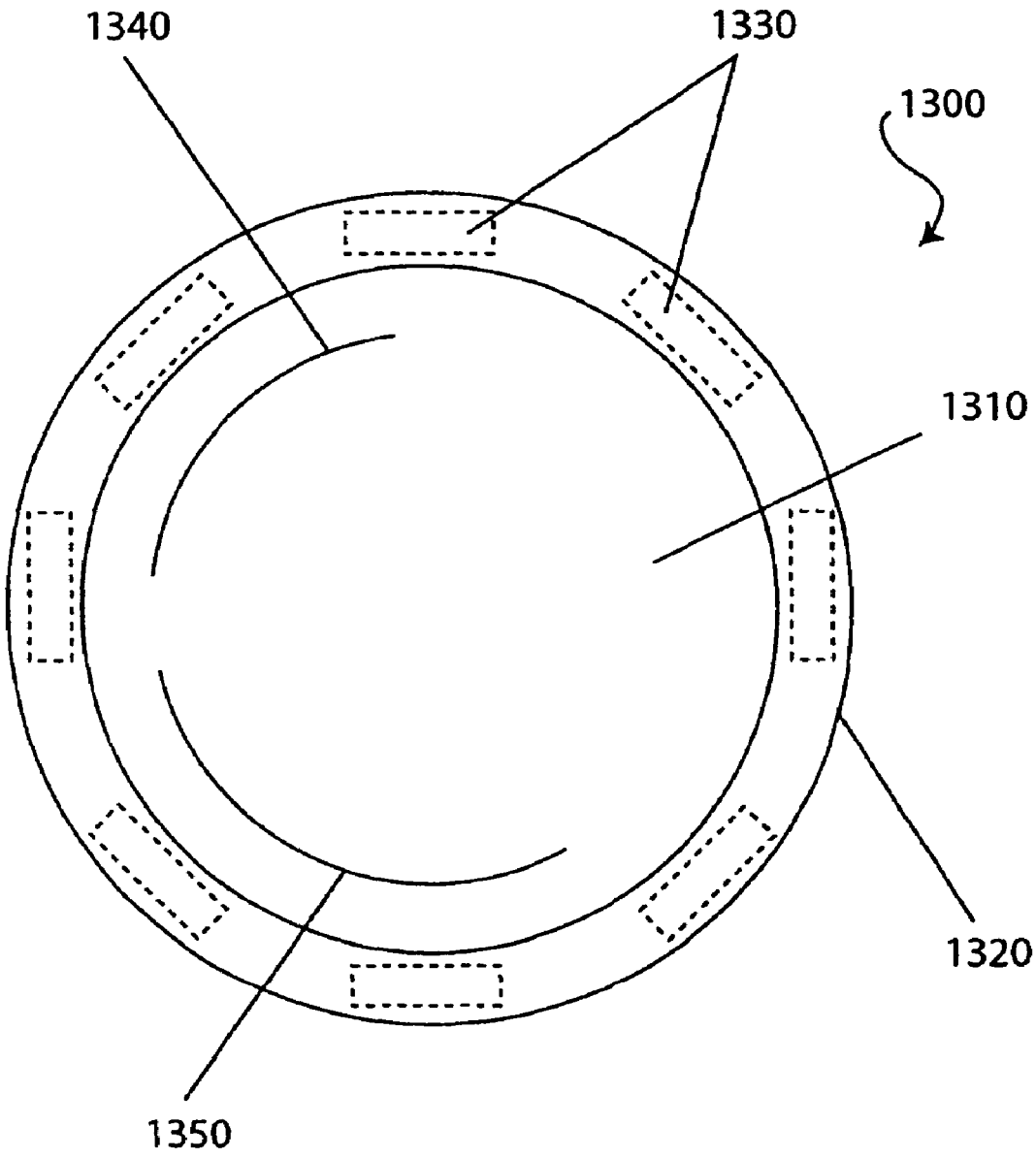
FIG. 13 is a top plan view of a plate constructed in accordance with an eleventh embodiment of the invention.

While the embodiments of FIGS. 12 and 13 have been described with respect to plates, the invention is equally applicable to any utilitarian object that may be adapted to house one or more microchips, such as a cup, napkin, napkin holder, swizzle stick, mixer, glass, placemat or the like. The audible questions and/or answers included in these embodiments may comprise questions and answers, and preferably comprise open-ended comments, questions asking for an opinion such as those described with respect to FIG. 1. Therefore, in a manner similar to the prior embodiments, such a plate would allow for the generation of conversation during a gathering.

Figure 14:
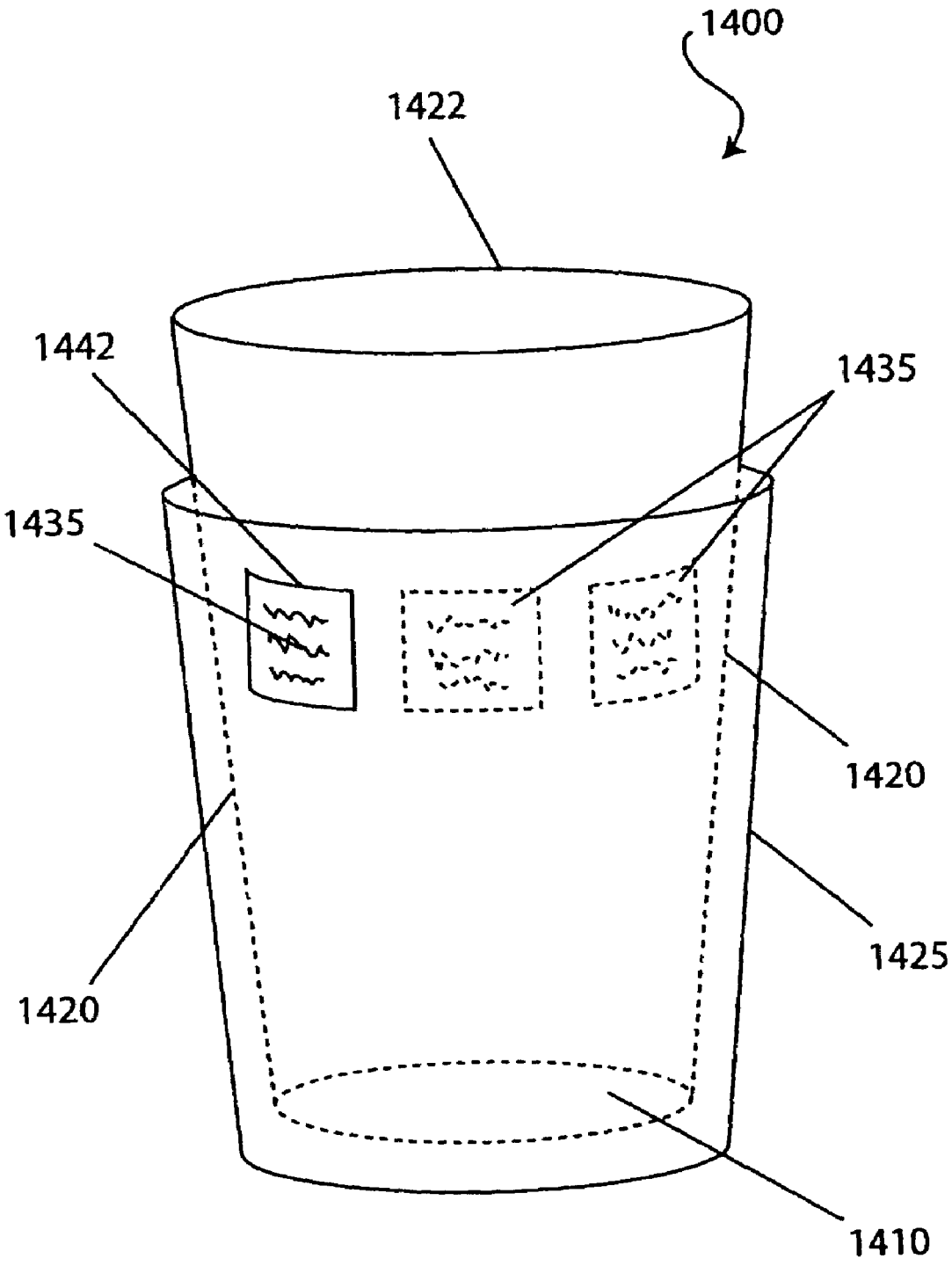
FIG. 14 is a perspective view of a cup combination constructed in accordance with a twelfth embodiment of the invention.

Referring next to FIG. 14, a cup constructed in accordance with a twelfth embodiment of the invention will be described. As is shown in FIG. 14, a cup 1400 includes a bottom portion 1410, side walls 1420 and a rim 1422. A sleeve 1425 is also provided coaxial with cup 1400, and enclosing the outer surface of bottom portion 1410 and side walls 1420. Rim 1422 extends beyond sleeve 1425 to allow for drinking from cup 1400. Sleeve 1425 defines a window 1442 therein. Window 1442 is positioned to allow for the selective viewing of one of a plurality of text portions 1435. A user is able to rotate sleeve 1425 relative to cup 1400 to view any one of the text portions. Sleeve 1425 is rotatably fixed to cup 1400 by any number of sliding mechanisms known in the art. The text portions included in this embodiment may comprise questions and answers, and preferably comprise open-ended comments, questions asking for an opinion such as those described with respect to FIG. 1. Therefore, in a manner similar to the prior embodiments, such a cup would allow for the generation of conversation during a gathering.

While one window 1442 is depicted as being defined in sleeve 1425, any number of windows may be defined. These may allow for the viewing of more than one question at a time, or may allow for the viewing of a question and answer pair, where appropriate. Furthermore, while a cup is disclosed, sleeve 1425 may enclose a can, bottle, glass, or other substantially cylindrical article having text material printed on the outside thereof lining up with window 1442. A rotatable connection mechanism is therefore provided for maintaining a rotatable connection between the sleeve and the substantially cylindrical article. Furthermore, the microchips noted above may be embedded in the sleeve and function in a manner similar to that noted above. Additionally, rather than placing the questions on the cup, can, bottle, glass or the like, a second inner cylindrical sleeve may be provided that fits inside sleeve 1425, and into which cup 1400 would fit. Sleeve 1425 would move relative to this inner sleeve, and selectively reveal questions or the like printed thereon.

Figure 15:
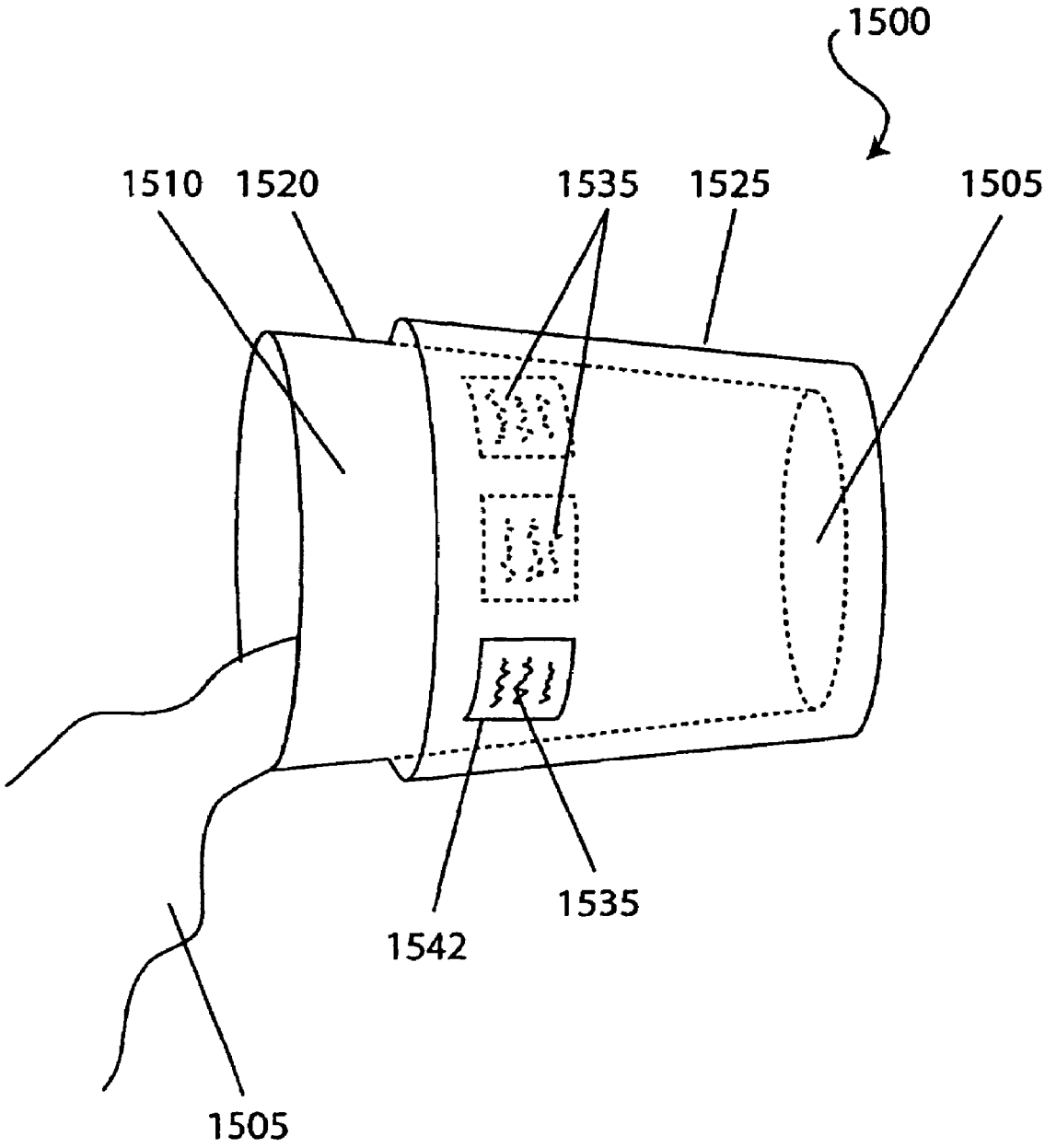
FIG. 15 is a perspective view of a napkin ring/holder combination constructed in accordance with a thirteenth embodiment of the invention.

Referring next to FIG. 15, a napkin holder constructed in accordance with a thirteenth embodiment of the invention will be described. As is shown in FIG. 15, a napkin holder 1500 includes an inner sleeve 1510 comprising side walls 1520, and an outer sleeve 1525 coaxial with each other. The napkin holder is adapted to hold a napkin 1505. Outer sleeve 1525 encloses inner sleeve 1510. A portion of inner sleeve 1510 extends beyond outer sleeve 1525 to allow a user to rotate outer sleeve 1525 relative to inner sleeve 1510. Outer sleeve 1525 defines a window 1542 therein. Window 1542 is positioned to allow for the selective viewing of one of a plurality of text portions 1535. Thus, by moving outer sleeve 1525 relative to inner sleeve 1510, a user is able to view any one of the text portions. Outer sleeve 1525 is rotatably fixed to inner sleeve 1510 by any number of sliding mechanisms known in the art. A rotatable connection mechanism is therefore provided for maintaining a rotatable connection between the outer sleeve and the inner sleeve. The text portions included in this embodiment may comprise questions and answers, and preferably comprise open-ended comments, questions asking for an opinion such as those described with respect to FIG. 1. Therefore, in a manner similar to the prior embodiments, such a cup would allow for the generation of conversation during a gathering.

The present invention may be used during any meal, such as breakfast, brunch, lunch, dinner, supper, a picnic, or at any time a conversation or a discussion between two or more persons is encouraged. Moreover, the present invention may find utility in various applications such as residential, commercial, corporate, cruise, and the like.

For purposes of the remainder of this description, the terms "conversationware" and "conversationware piece" shall each include any plate, saucer, charger, bowl, cup, glass, goblet, napkin holder, napkin, placemat, table utensil, table decoration, place card, name card, party favor, fast-food container, clamshell, tray liner, cup sleeve, insulating sleeve, and/or any other piece or item used for a meals, appetizers, or social gathering, such as breakfast, brunch, lunch, dinner, supper, a picnic, a cocktail party, and the like. The terms "conversationware" and "conversationware piece" may be used interchangeably. This conversationware shall be made of conventional materials, such as china, earthenware, stoneware, porcelain, plastic, glass, silver, gold, steel, paper, expanded rigid polystyrene plastic such as STYROFOAM™, EARTHSHELL™, BIOMAX™, or any other material or composition commonly used in manufacturing formal, everyday, or disposable conversationware products.

Figure 16:
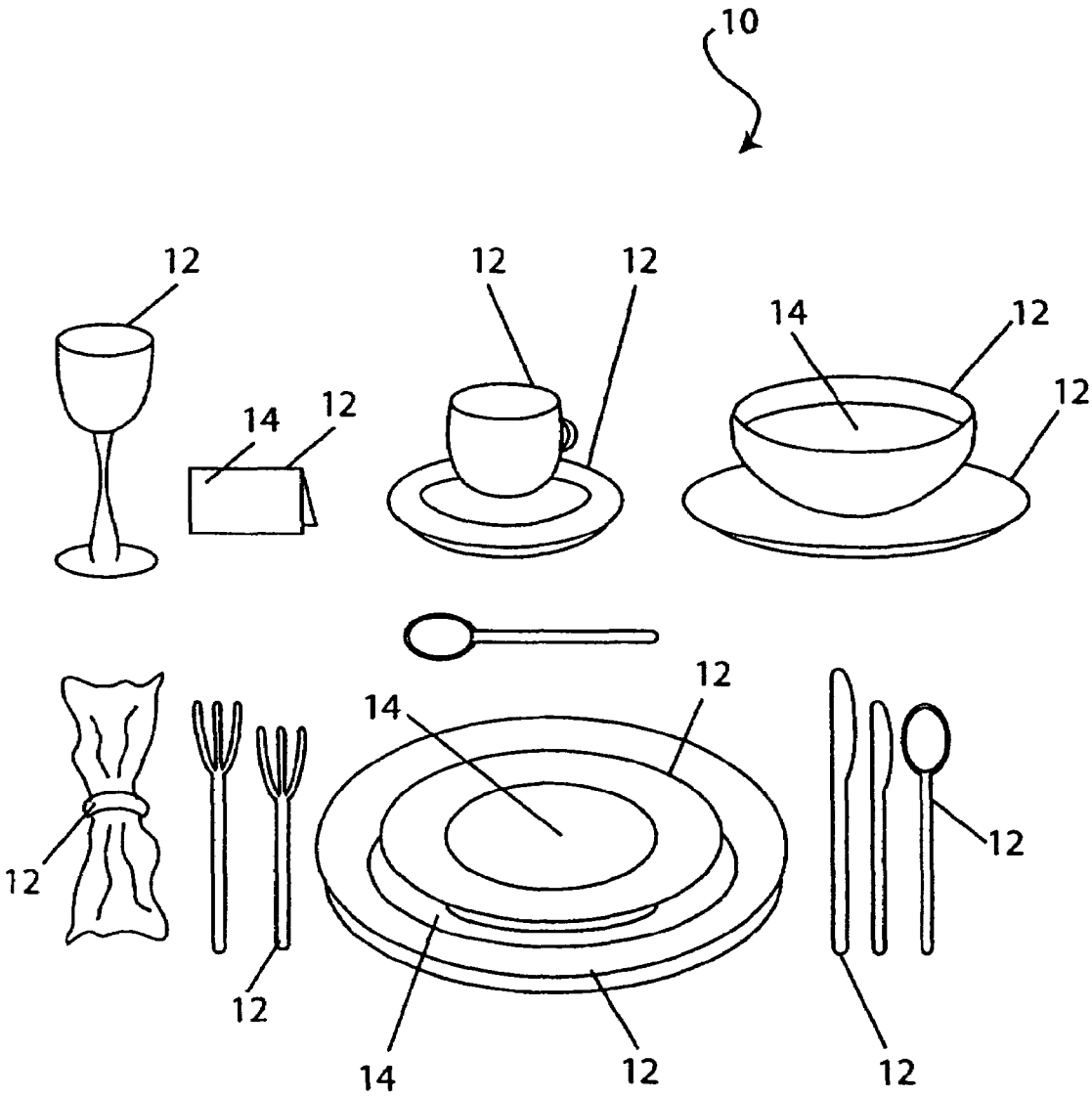
FIG. 16 is a perspective view of a table place setting for entertaining according to the principles of the present invention.
Figure 17:
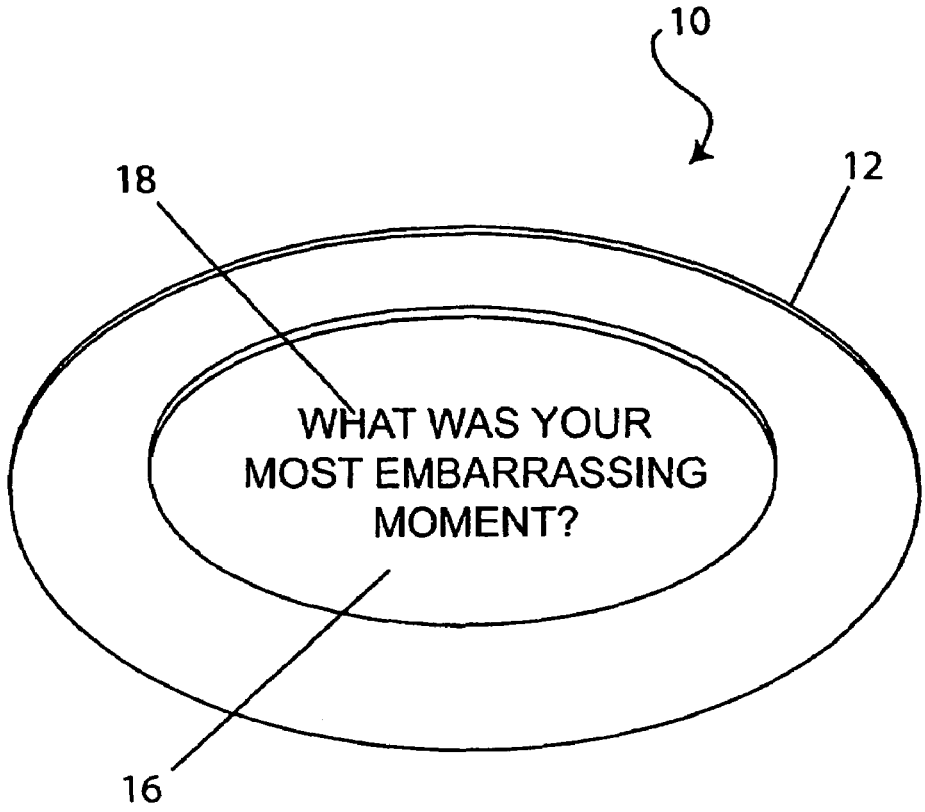
FIG. 17 is a bottom perspective view of a conversation-generating apparatus having an open-ended question printed on an unexposed surface thereof according to the principles of the present invention.
Figure 18:
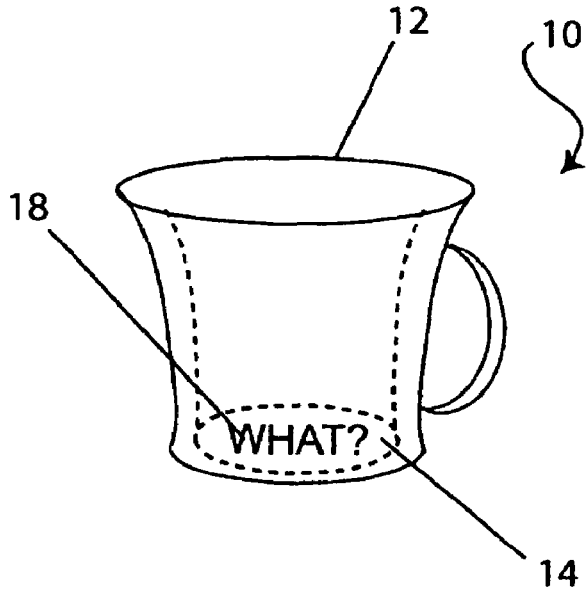
FIG. 18 is a perspective view, with hidden sections, of another conversation-generating apparatus having the open-ended question printed on an exposed surface thereof.

Referring to FIGS. 16-18, a conversation-generating apparatus 10 according to a sixteenth embodiment of the invention is illustrated. Conversation-generating apparatus 10 includes at least one conversationware piece 12 defining a top or exposed surface 14 and a bottom or unexposed surface 16. Exposed surface 14 is generally exposed to the view of the user when conversationware piece 12 is placed on a table and, in terms of a plate, would be the side in which food or other conversationware is placed. On the other hand, unexposed surface 16 is generally concealed from the view of the user when conversationware piece 12 is placed on a table and, again in terms of a plate, would be the non-food side that is placed downwardly. It is anticipated that conversation-generating apparatus 10 may include any number of conversationware or dining pieces.

Each conversationware piece 12 may include an open-ended question or command 18 printed on a surface thereof or otherwise affixed thereto. In the interest of brevity, open-ended question or command 18 will be referred to as open-ended question 18 unless otherwise noted. However, it should be appreciated that a command that instructs a guest to describe an experience, situation, opinion, or the like is within the scope of this invention.

Preferably, open-ended question 18 is printed on unexposed surface 16 of conversationware piece 12 to prevent a user from reading the question or command prior to a discussion or conversation. Alternatively, open-ended question 18 may be concealed by other means, which will be described in detail below. However, open-ended question 18 may also be printed on exposed surface 14 of conversationware piece 12 to be preferably covered by food or other conversationware.

It is anticipated that open-ended question 18 is printed on or affixed to conversationware piece 12 in a known manner, such as by forming the lettering under a coating applied to the conversationware piece either during or after the manufacturing process. This printing method would allow for a smooth, unobstructed, durable finish on the surface thereof. Such printing of open-ended question 18 in this manner also prevents the lettering from contaminating any food items placed on or in conversationware piece 12. However, it should be appreciated that any printing or affixing method known to one skilled in the art may be used.

Figure 19:
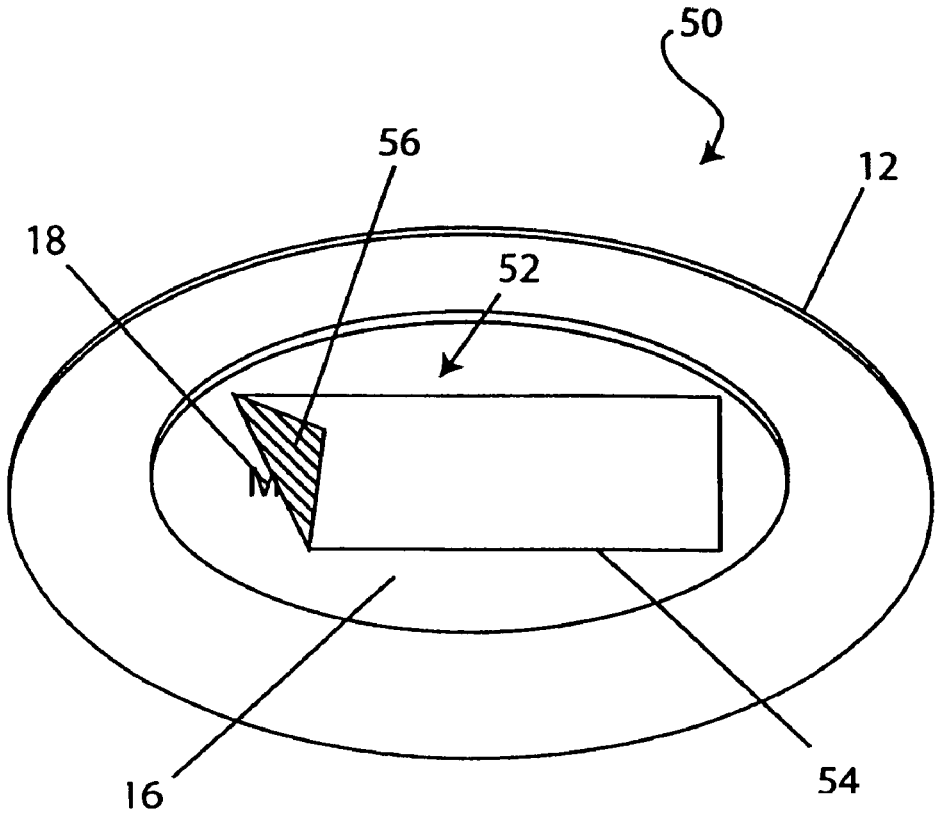
FIG. 19 is a bottom perspective view of a conversation-generating apparatus having a revealing member being an adhesive strip selectively revealing the open-ended question according to the principles of the present invention.
Figure 20:
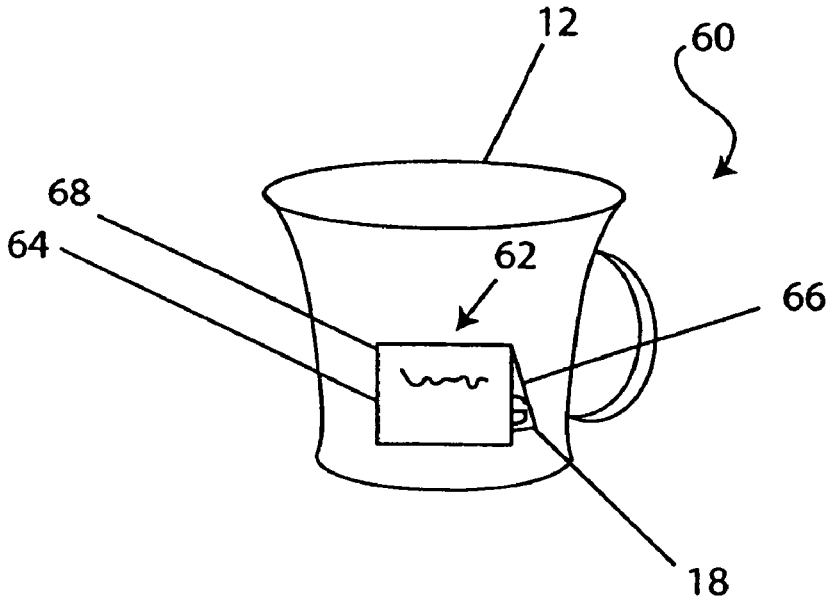
FIG. 20 is a perspective view of a conversation-generating apparatus having a revealing member being a pivotable, perforated tab selectively reveling the open-ended question according to the principles of the present invention.
Figure 21:
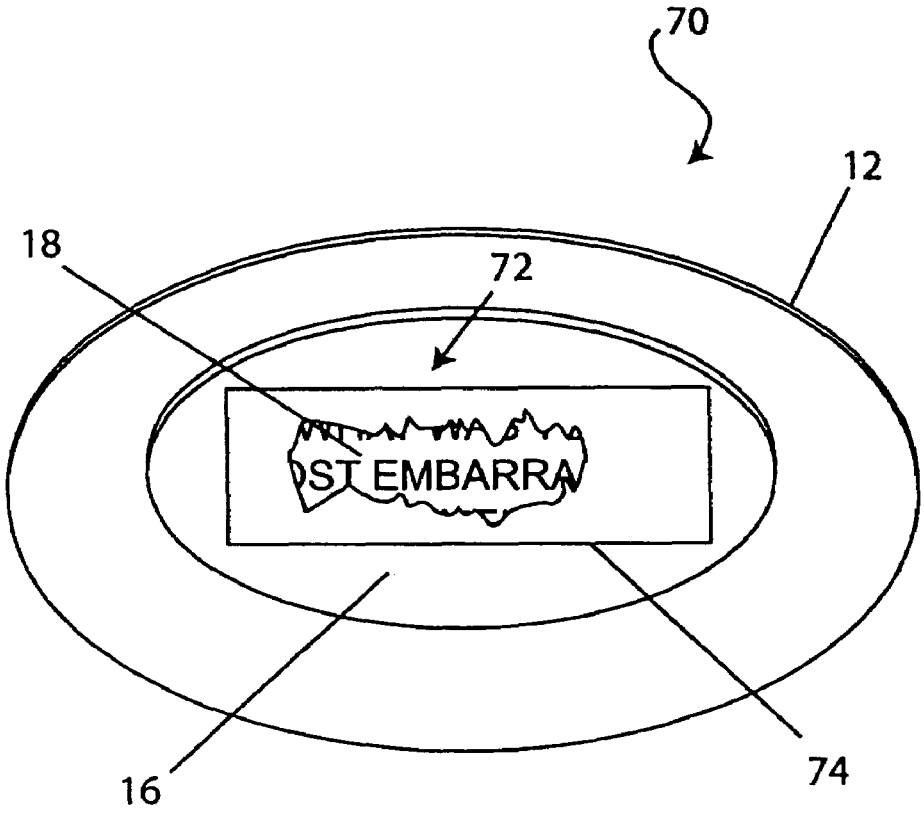
FIG. 21 is a bottom perspective view of a conversation-generating apparatus having a revealing member being a scratch-off opaque surface selectively revealing the open-ended question according to the principles of the present invention.

Referring now to FIGS. 19-21, a conversation-generating apparatus 50 according to a seventeenth embodiment of the invention is illustrated. It should be noted that like reference numeral indicate like features. Accordingly, in addition to the features described above, conversation-generating apparatus 50 further includes a selectively revealing member 52. Selectively revealing member 52 is positioned relative to open-ended question 18 such that revealing member 52 covers or at least obscures open-ended question 18 to prevent or deter a conversation partner from reading open-ended question 18 prior to a discussion or conversation.

Specifically, as seen in FIG. 19, revealing member 52 may be a strip member 54 having an adhesive or other retaining material 56 disposed thereon to facilitate the adherence of strip member 54 to conversationware piece 12. Although revealing member 52 is illustrated in conjunction with a conversationware piece 12 being a plate, it should be understood that conversationware piece 12 may be any of the aforementioned conversationware pieces. Moreover, it is anticipated that strip member 54 may be constructed having any number of various shapes, colors, or textures. For example, it may be preferable to shape strip member 54 to resemble a coffee bean when used in conjunction with coffee cups.

Alternatively, as seen in FIG. 20, a revealing member 62 of an object 60 is provided having a tab member 64 that is fixedly mounted to conversationware piece 12. Preferably, tab member 64 is fastened to conversationware piece 12 via a perforated seam 66 such that revealing member 62 covers or at least obscures open-ended question 18 to prevent or deter a conversation partner from reading open-ended question 18 prior to a discussion or conversation. Perforated seam 66 forms an interface between tab member 64 and conversationware piece 12. Tab member 64 is formed such that a portion 68 of tab member 64 remains affixed to conversationware piece 12 following lifting from conversationware piece 12; however, it is anticipated that tab member 64 may be completely removed from conversationware piece 12, if desired. Portion 68 of tab member 64 is fixed to conversationware piece 12 via an adhesive or similar material, such as glue.

Referring now to FIG. 21, yet another revealing member of an object 70 is provided having a scratch-off portion 74 disposed on a surface of conversationware piece 12. Scratch-off portion 74 includes a base layer adapted to receive pre-printed open-ended question 18, which is covered by a removable opaque layer. Scratch-off portion 74 is selectively revealable by scratching off the opaque layer to reveal preprinted open-ended question 18 therebelow. Scratch-off technology is readily used in conjunction with state lottery tickets. Accordingly, in the interest of brevity, it is believed that it is well within the ordinary skill in the art to manufacture such scratch-off surfaces, therefore additional disclosure is not deemed necessary.

Figure 22:
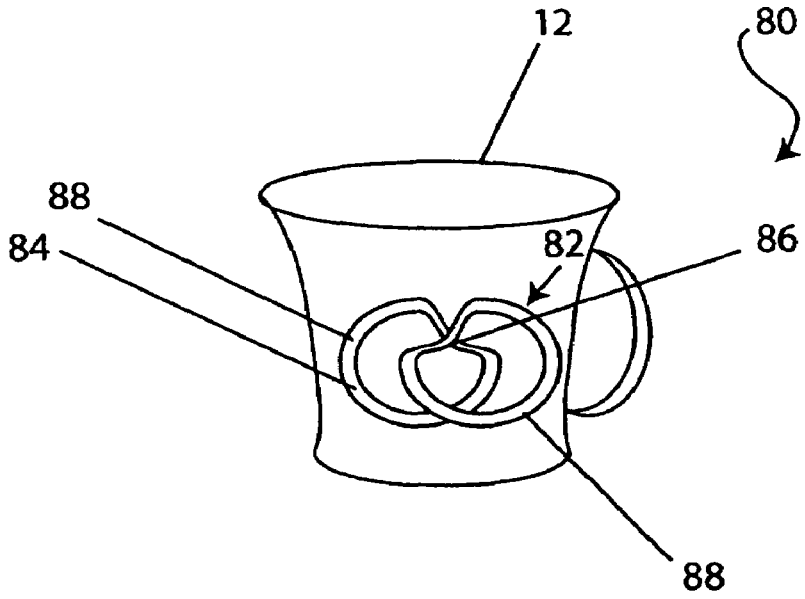
FIG. 22 is a perspective view of a conversation-generating apparatus having a revealing member being a pivotable handle structure selectively revealing the open-ended question according to the principles of the present invention.
Figure 23:
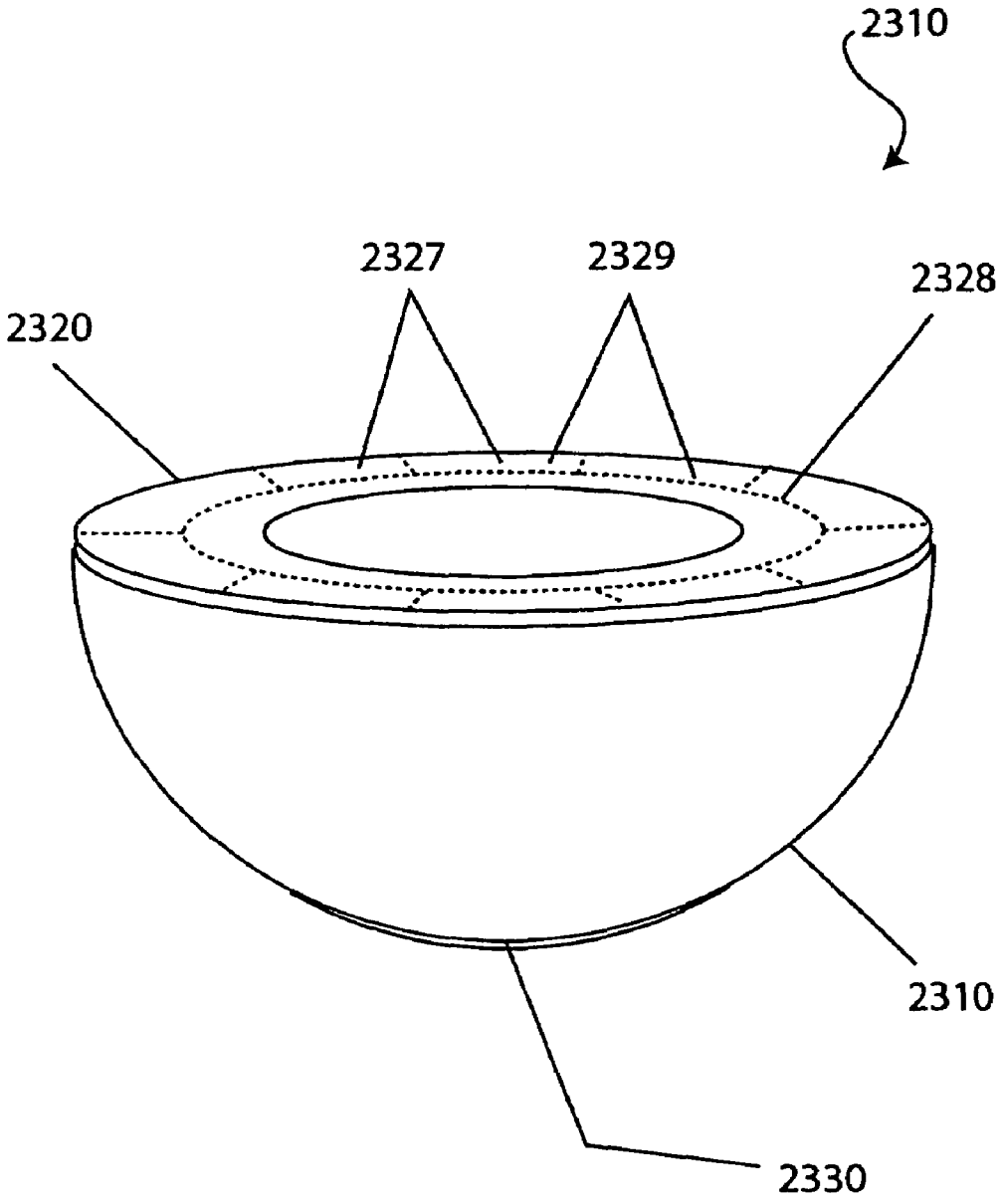
Figure 24:
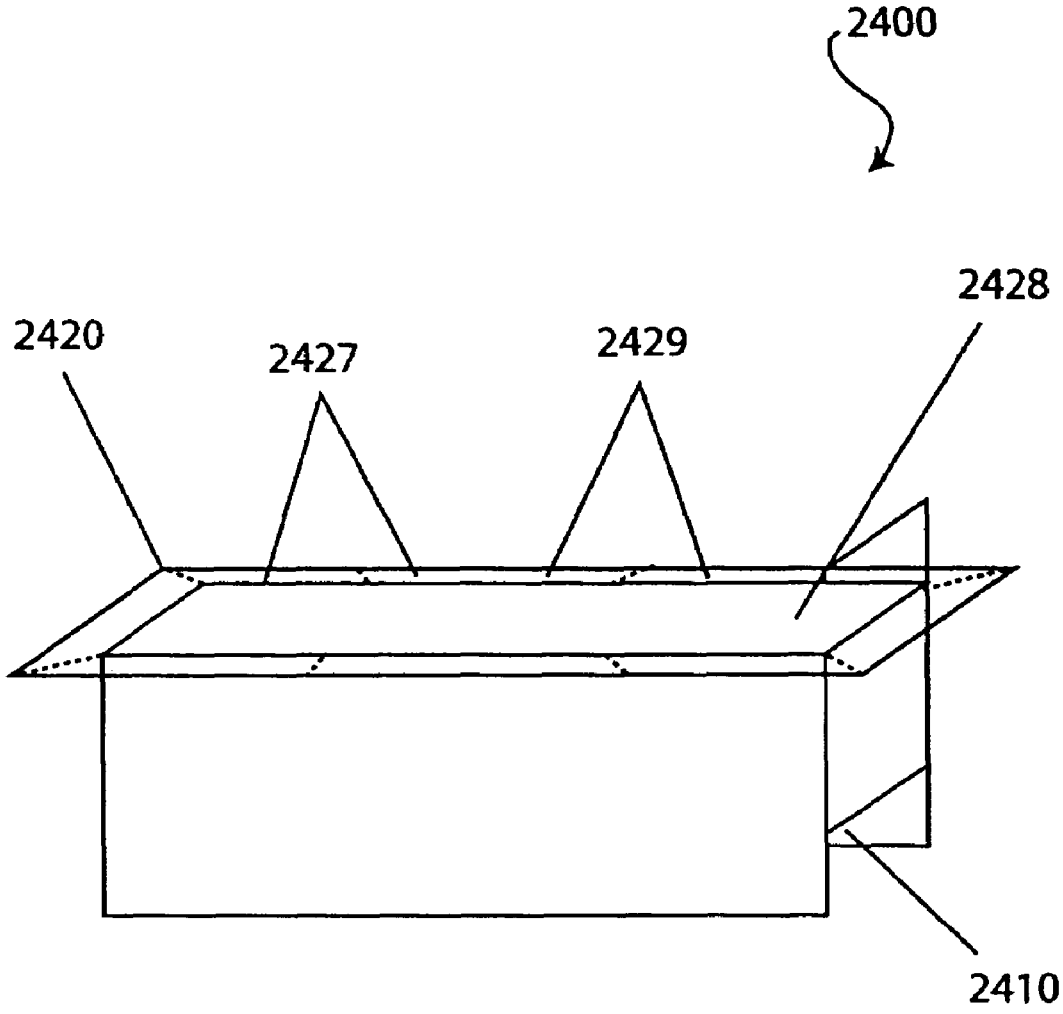
Figure 25:
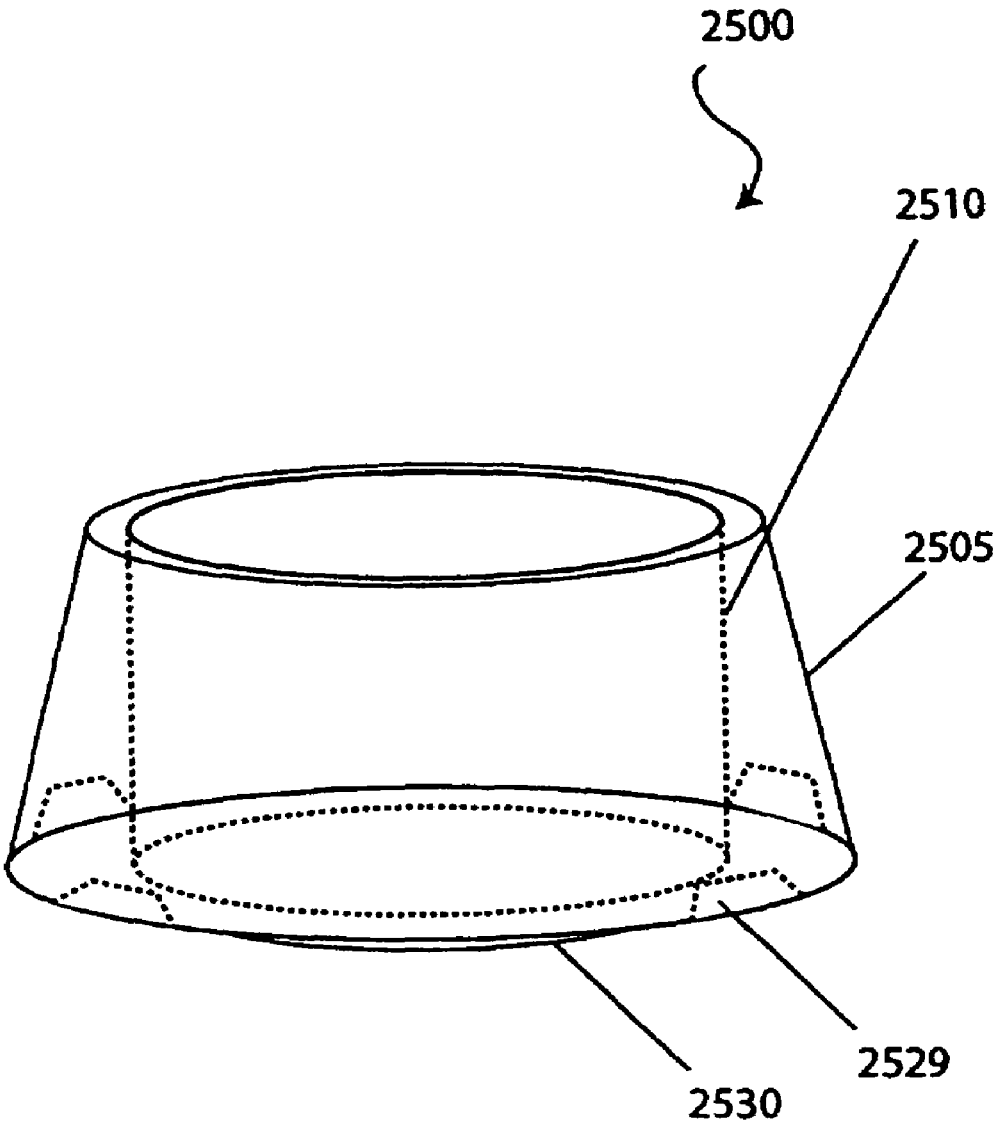
Figure 26:
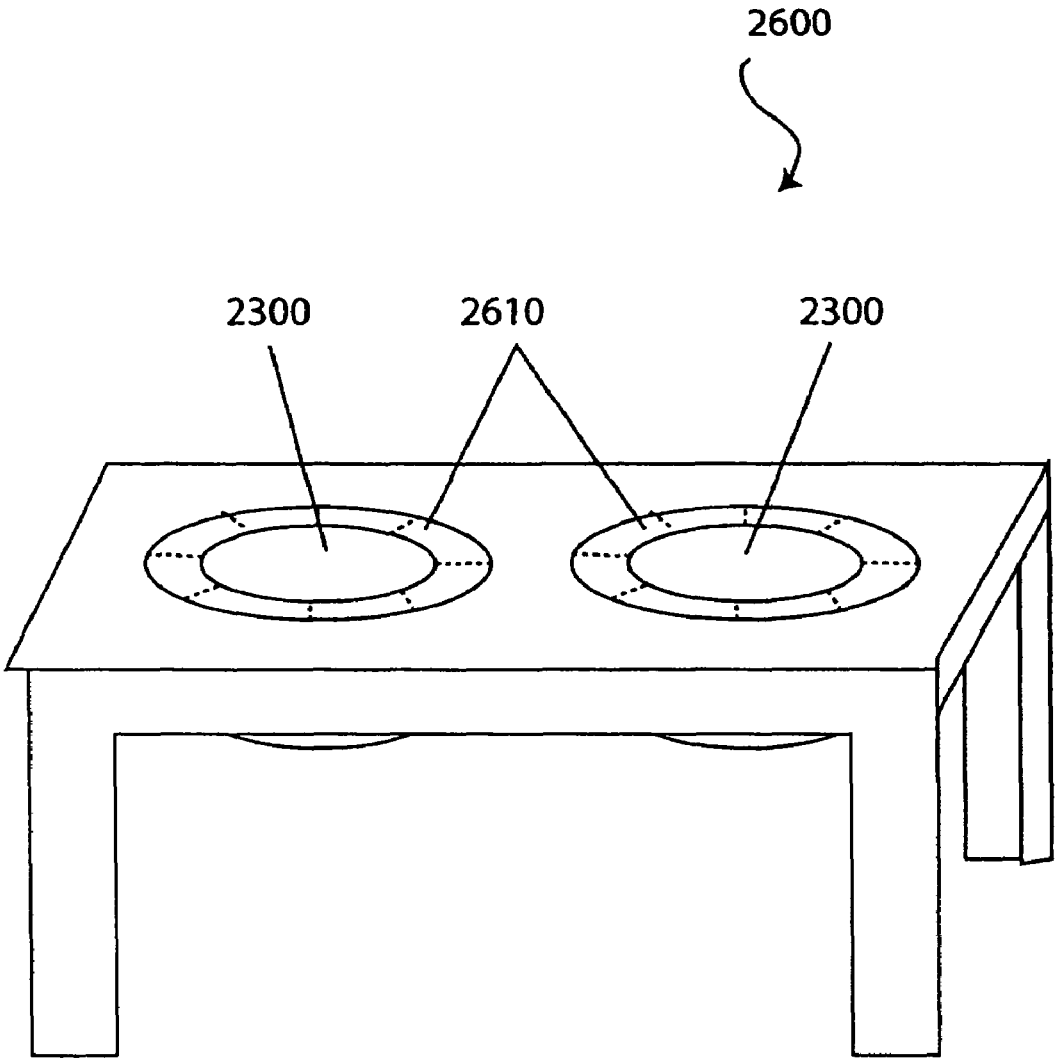
Figure 27:
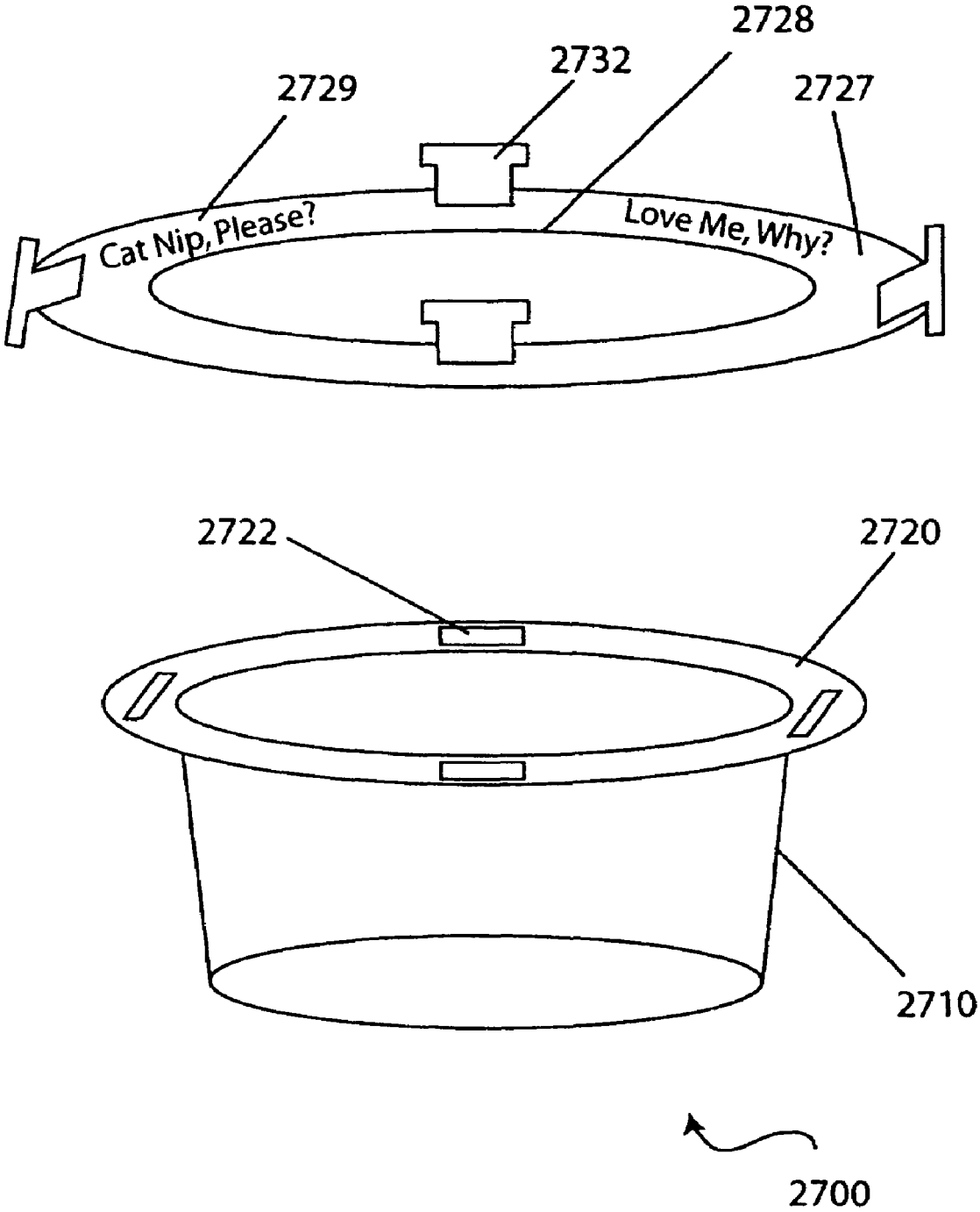
Figure 28:
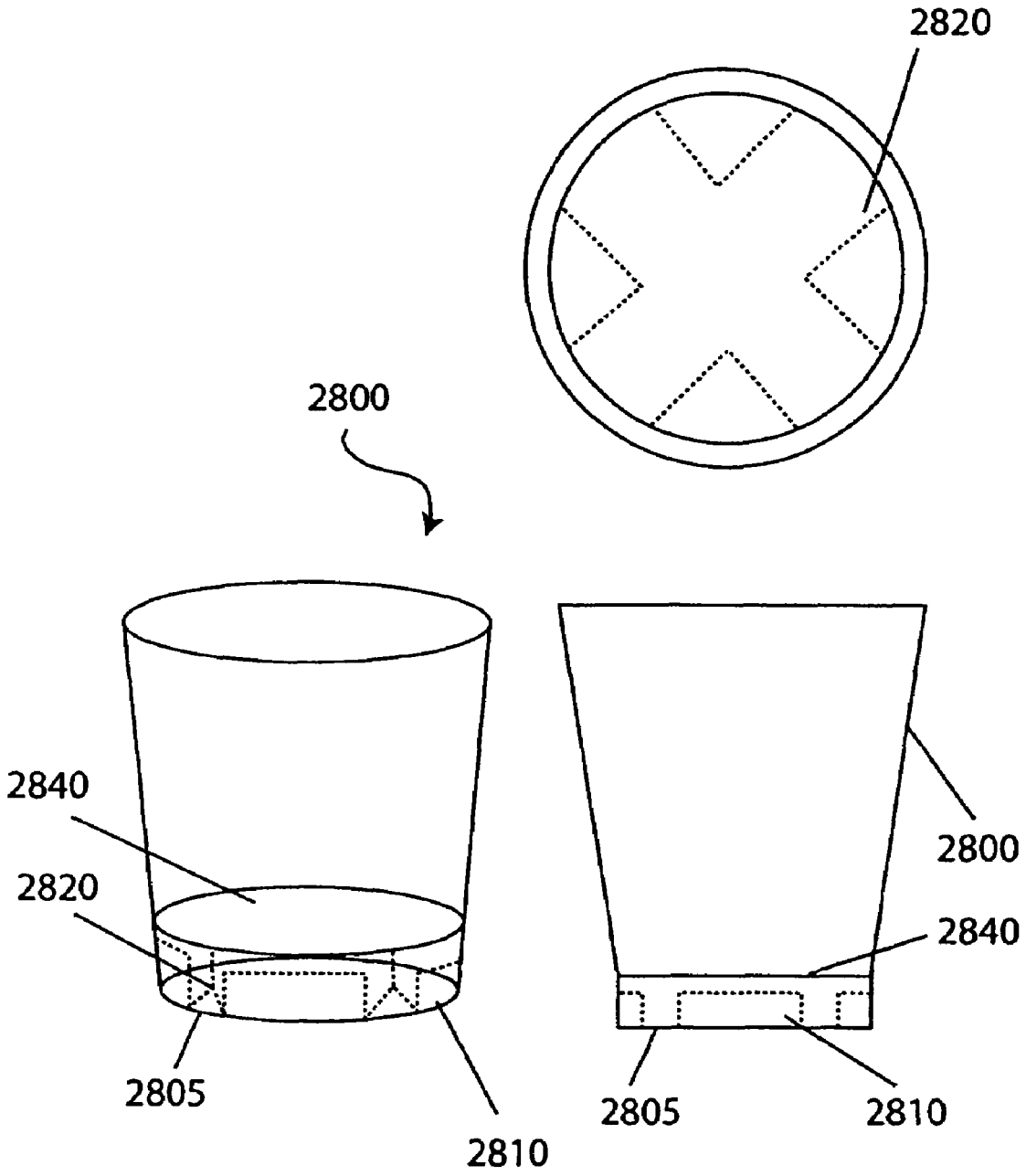
Figure 29:
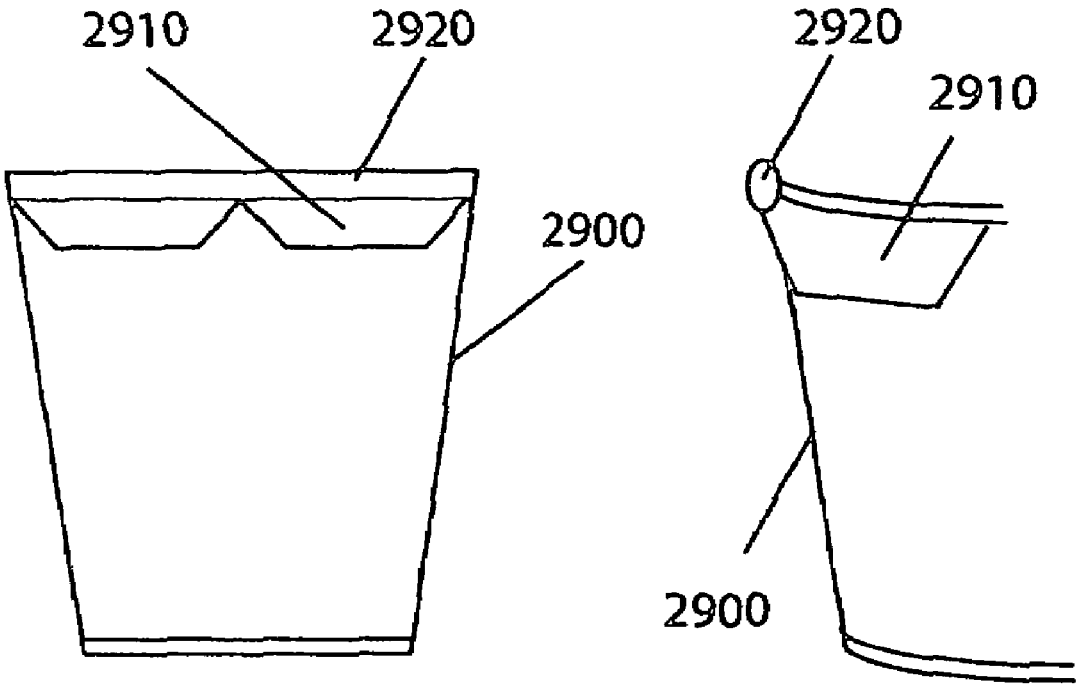
Figure 30:
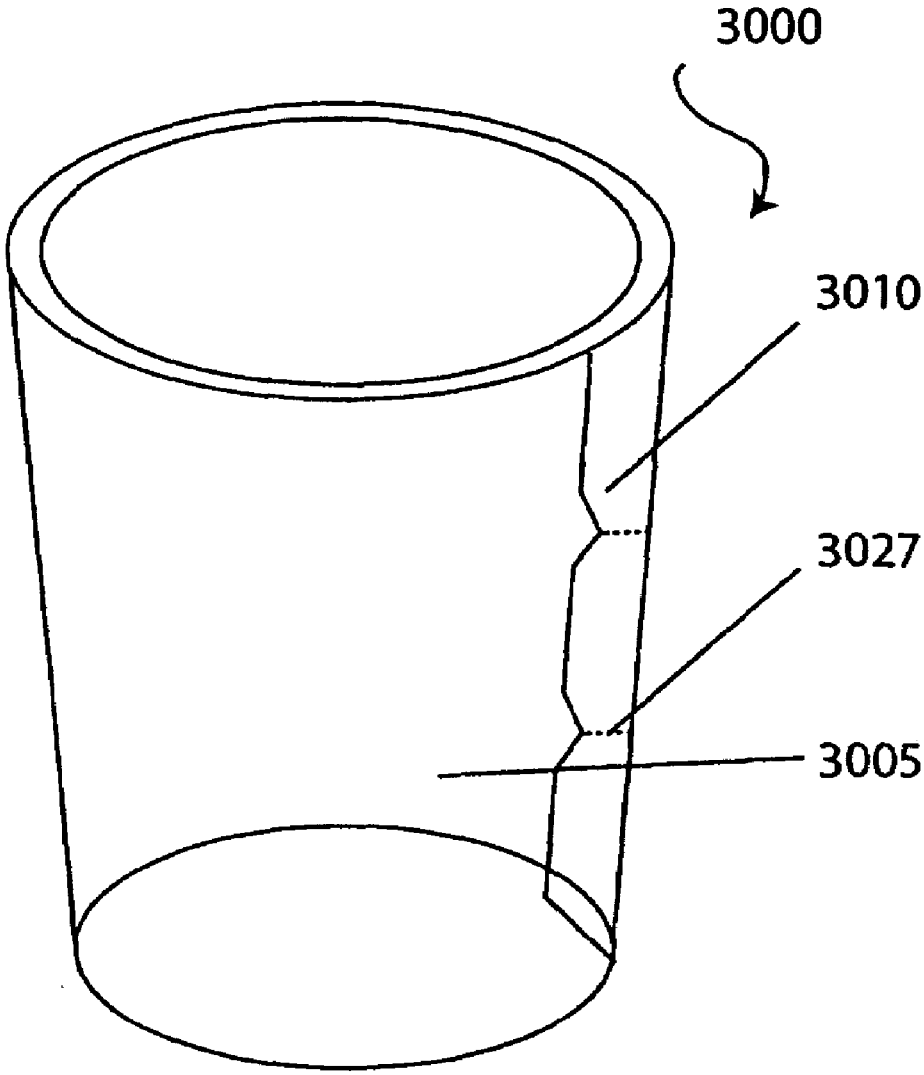
Figure 31:
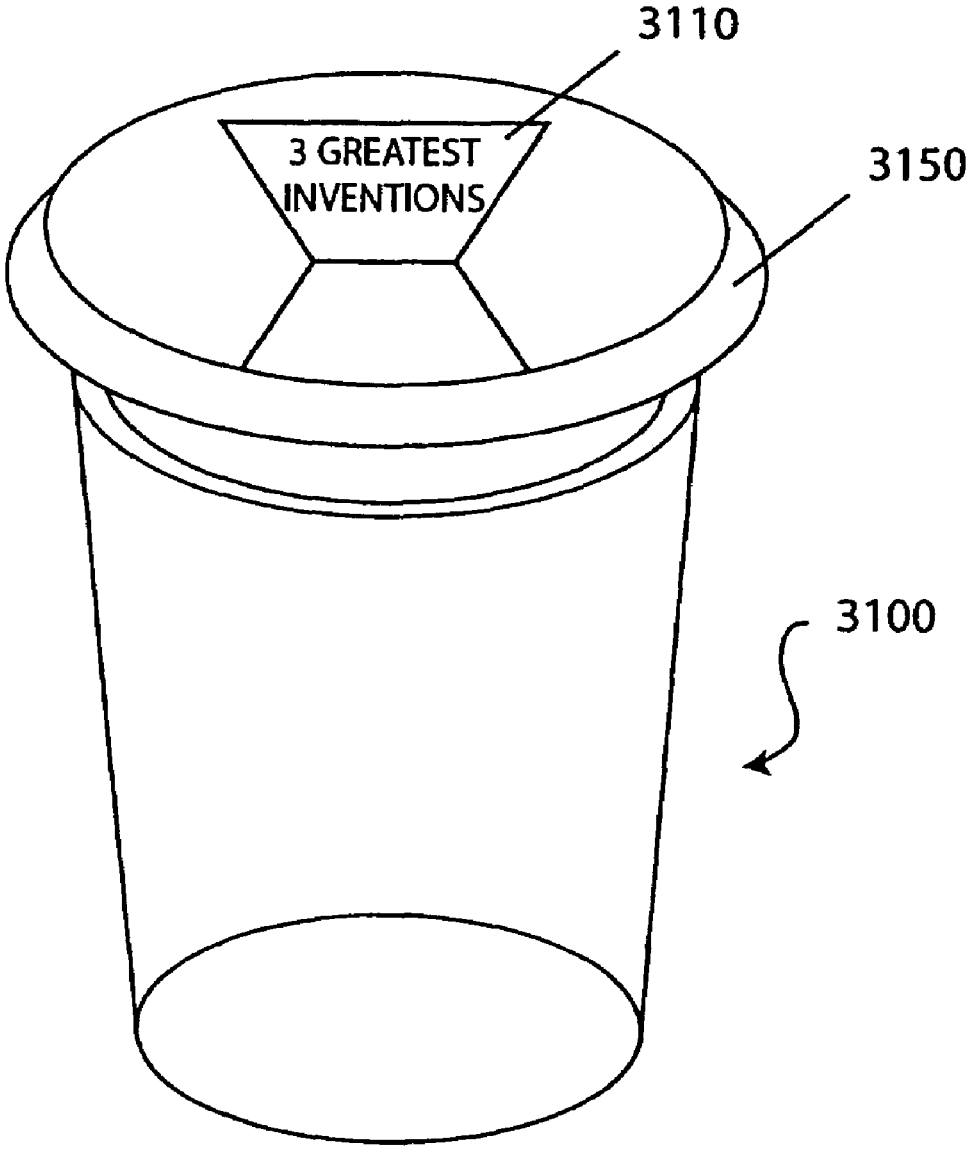
Figure 32:
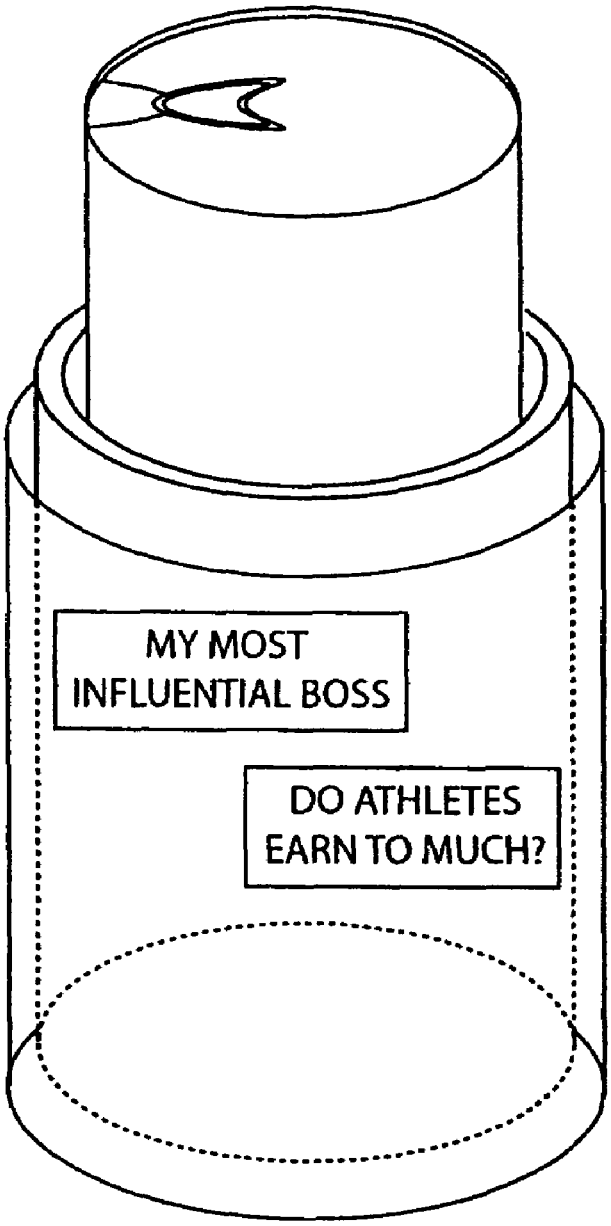
Figure 33:
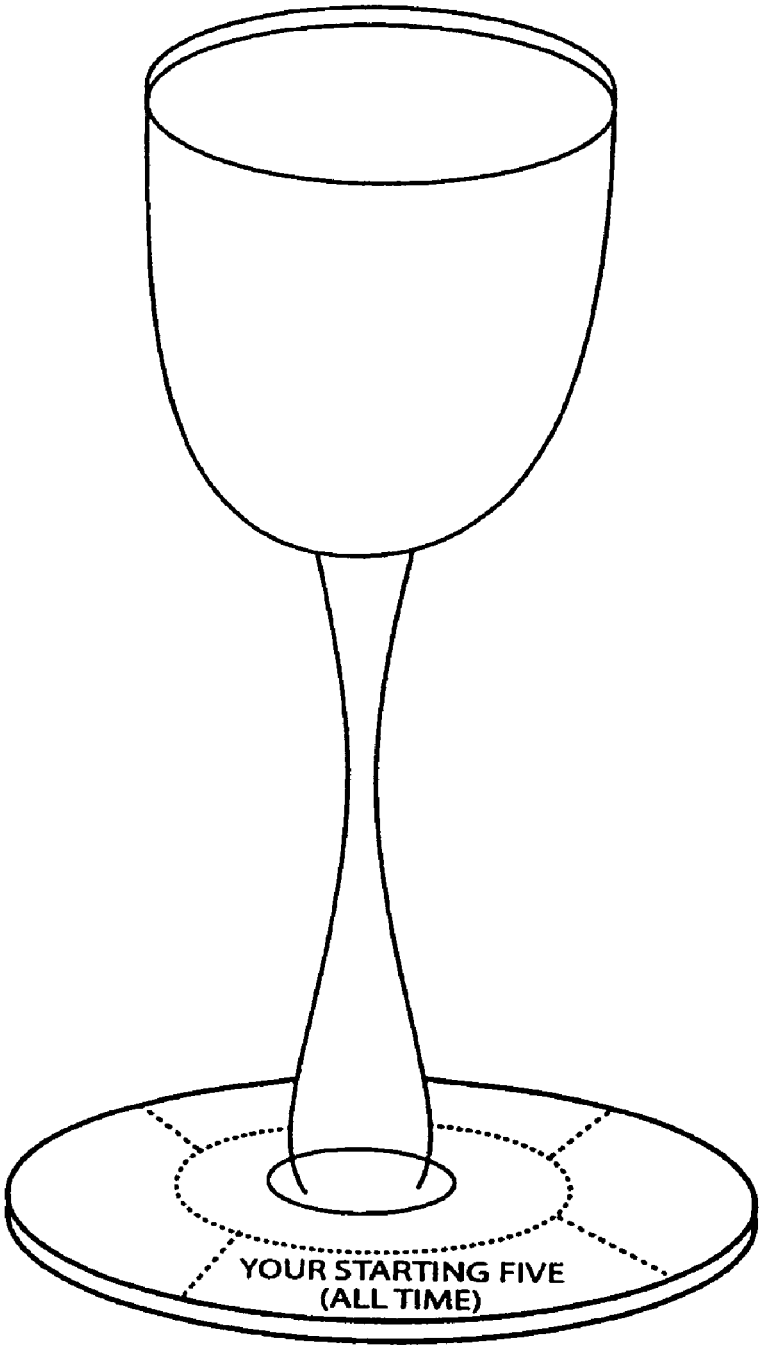
Figure 34:
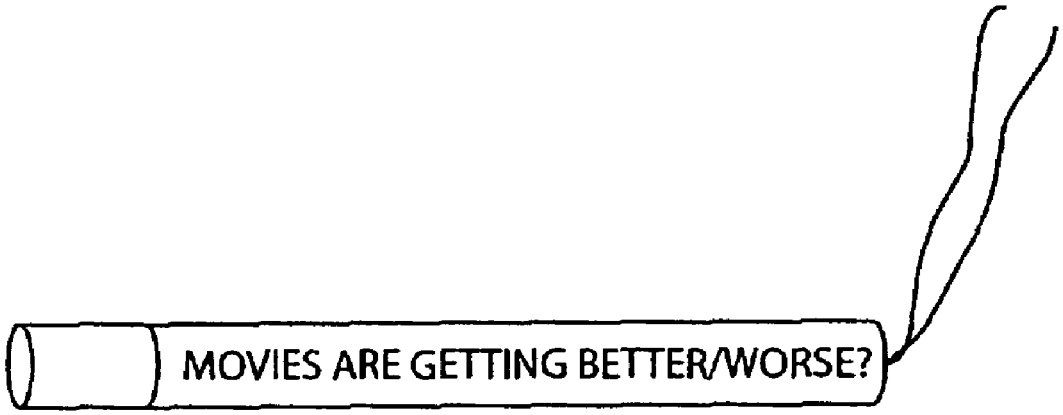
Figure 35:
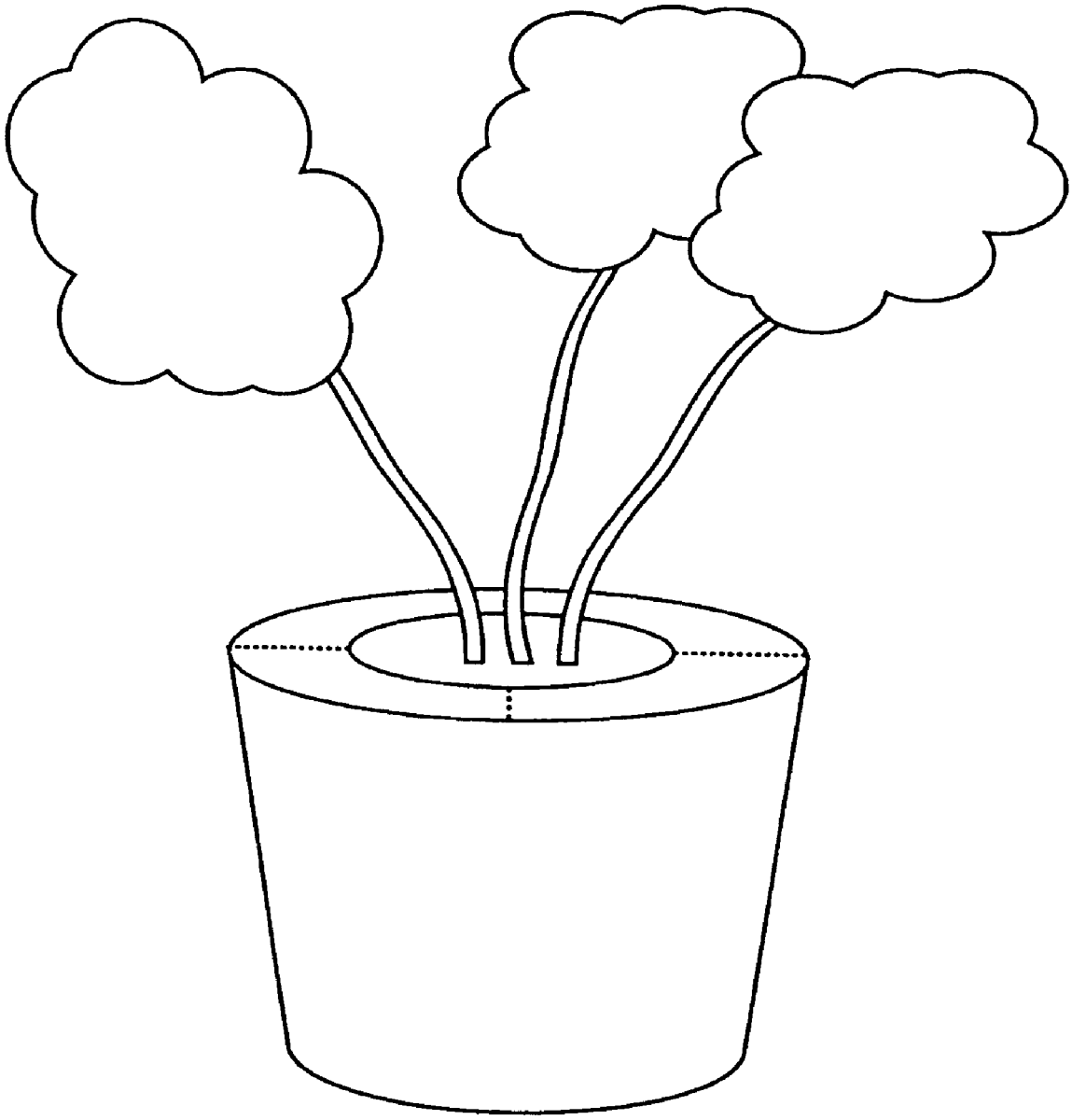
Figure 36:
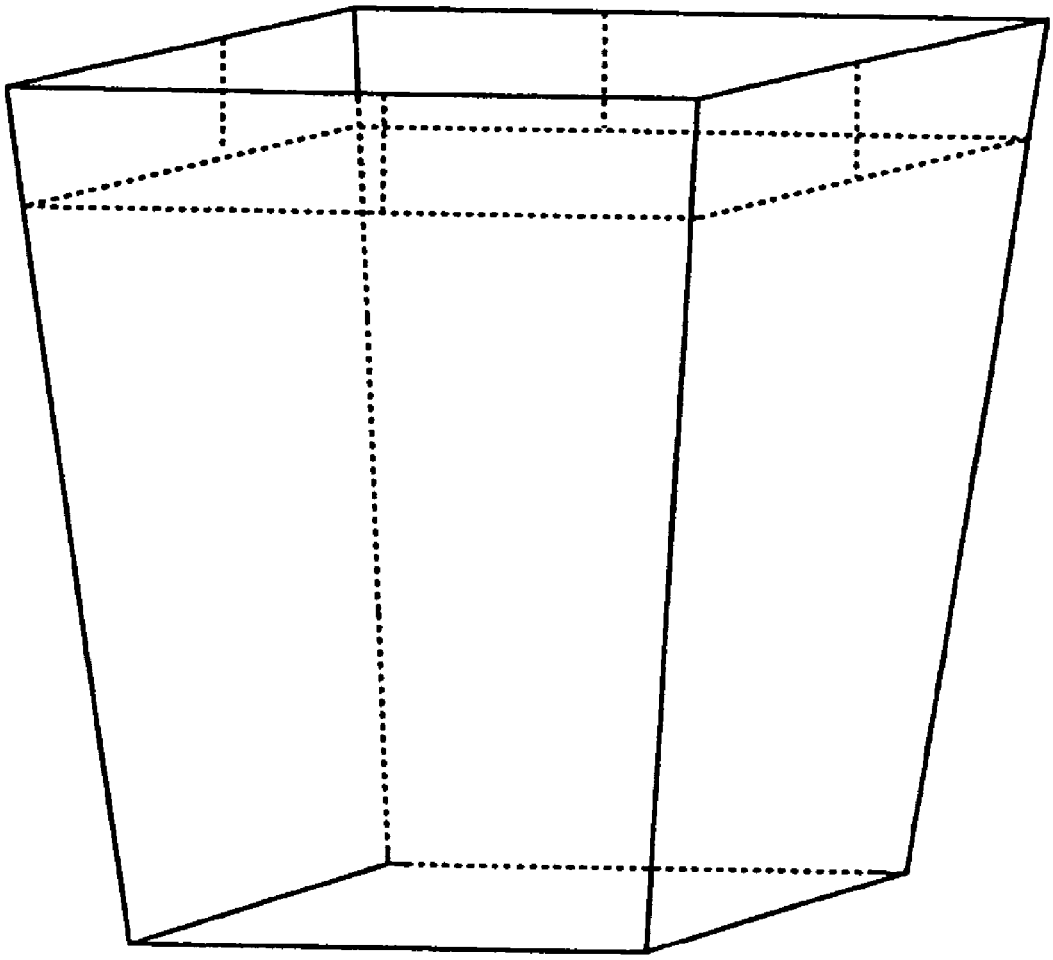
Figure 37:
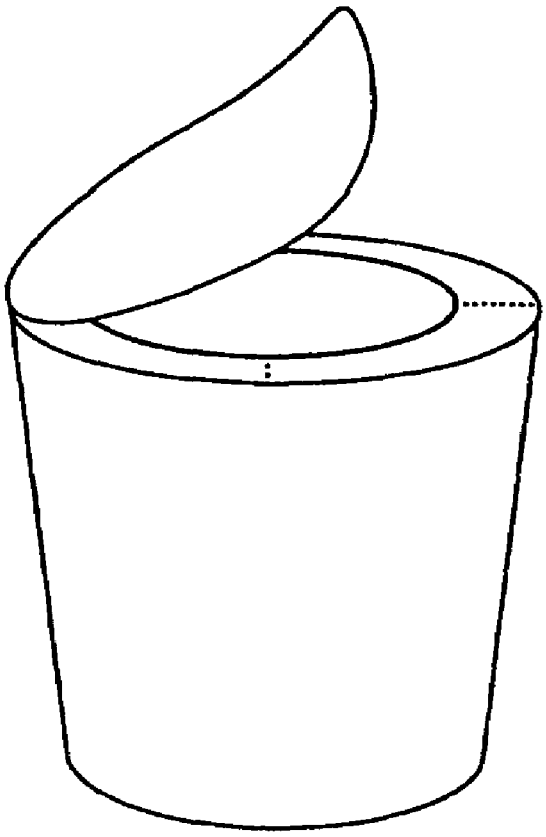
Figure 38:
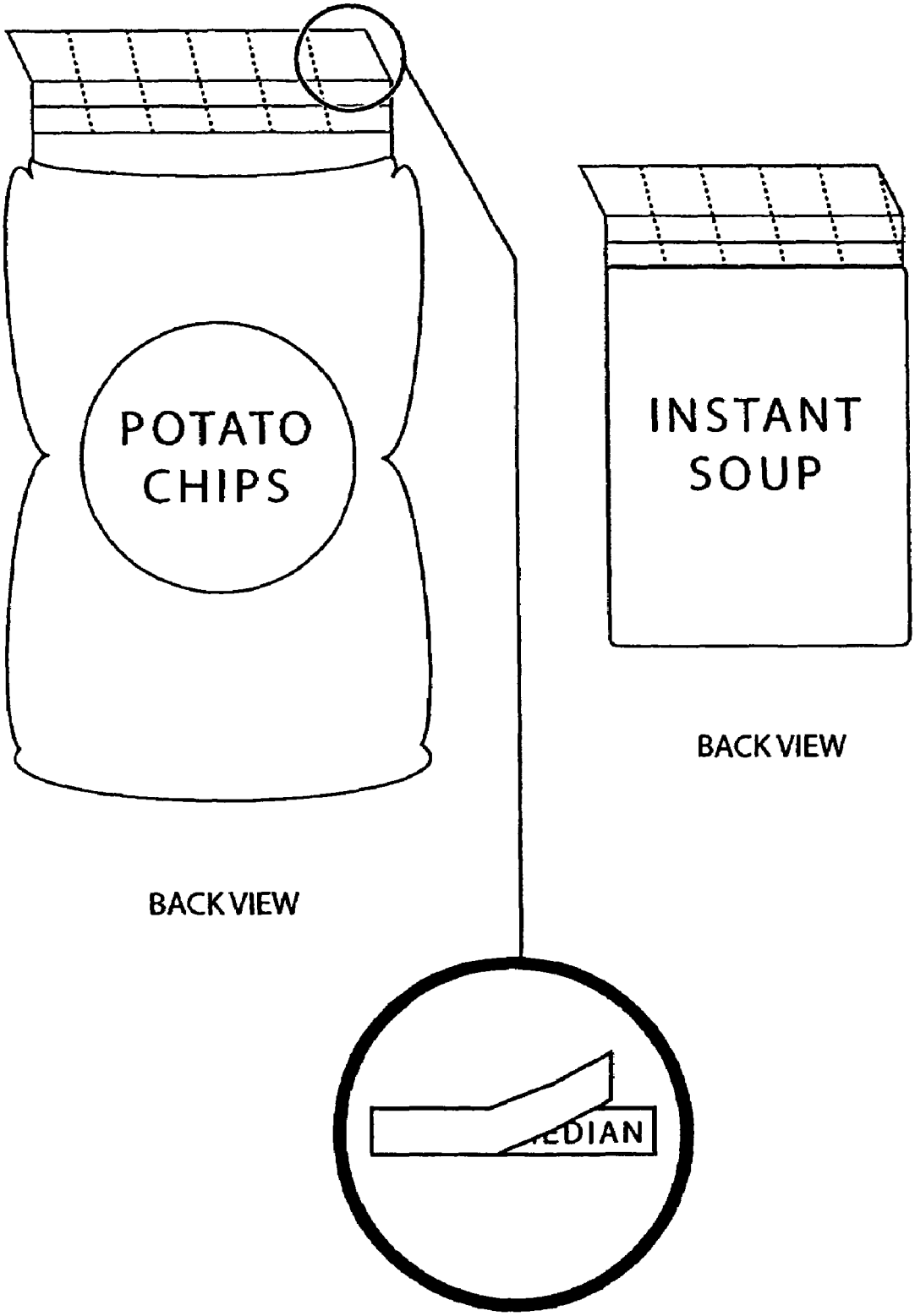
Figure 39:
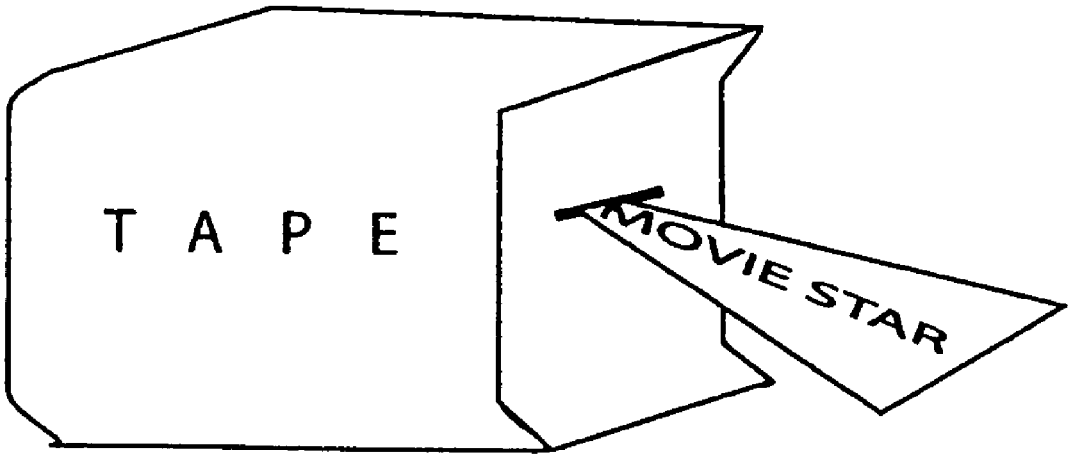
Figure 40:
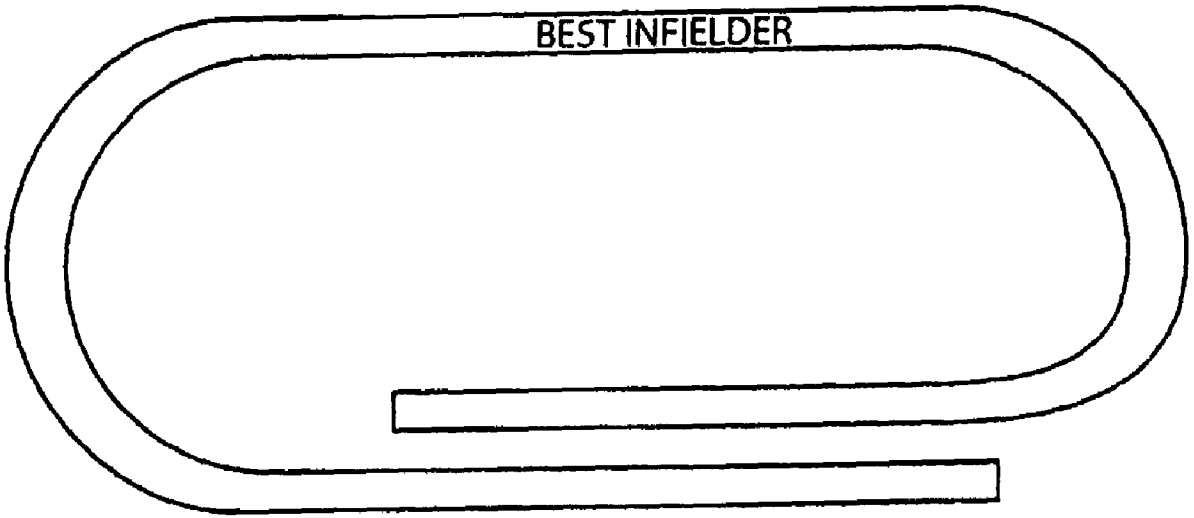
Figure 41:
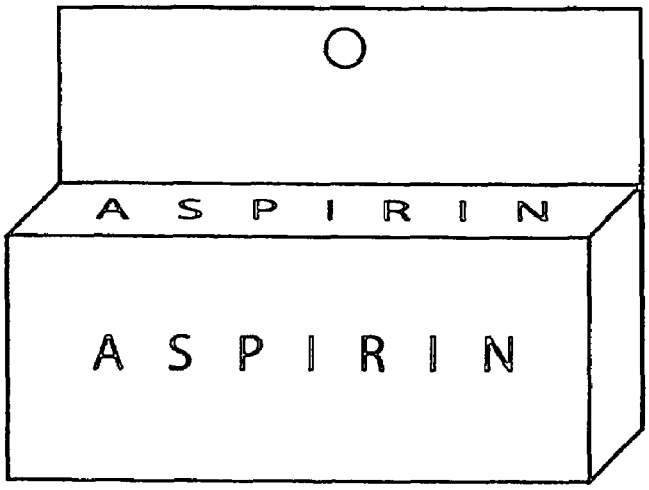
Figure 41:
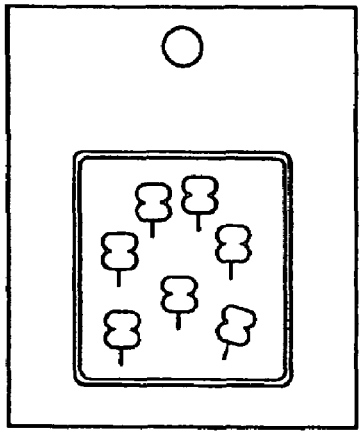
Figure 41:
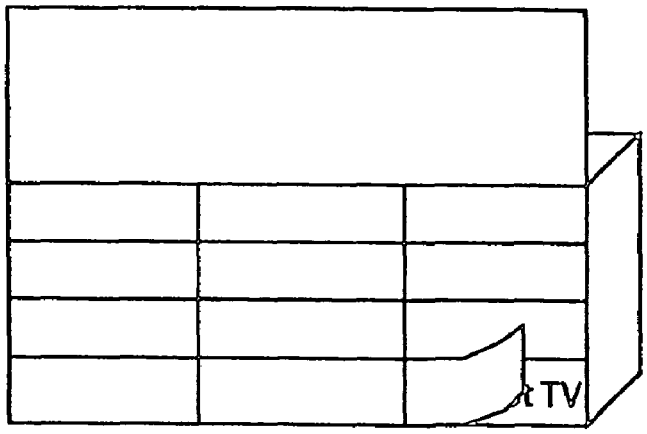
Figure 42:
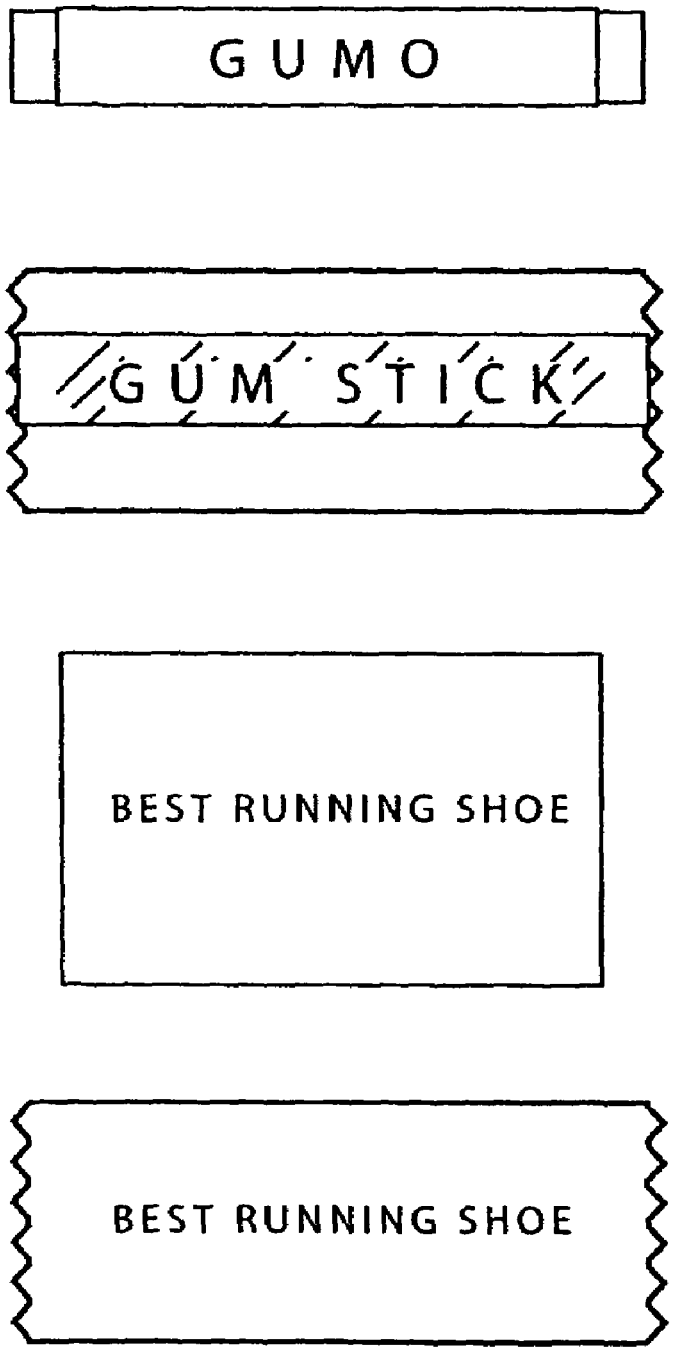
Figure 43:
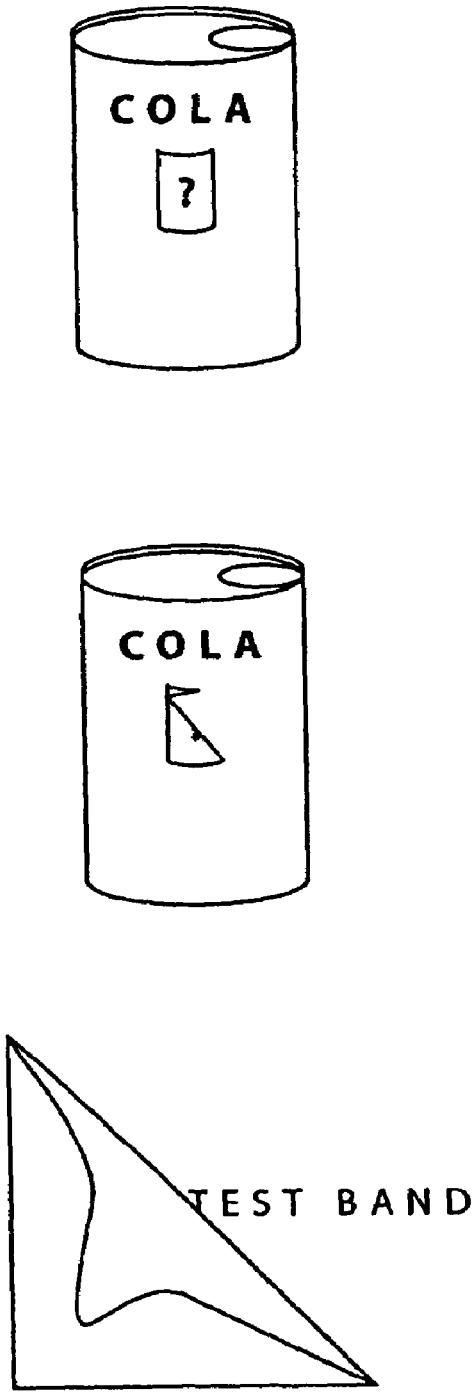
Figure 44:
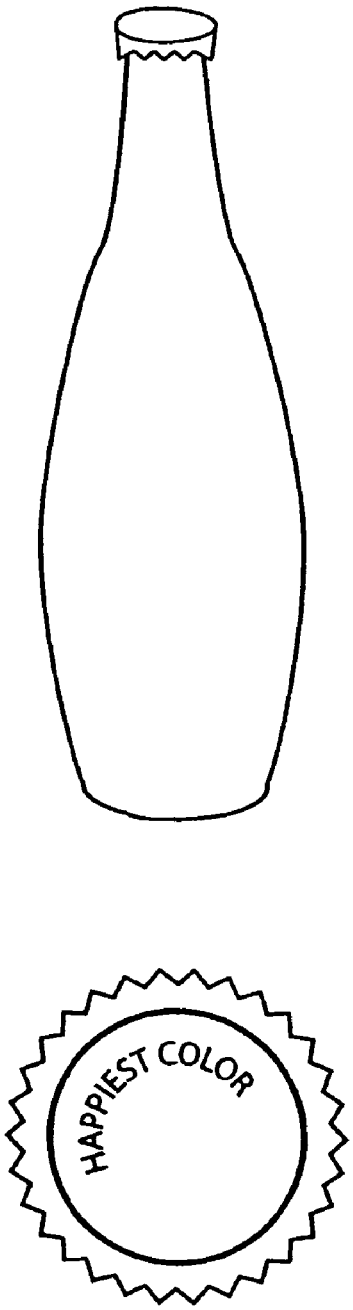
Figure 45:
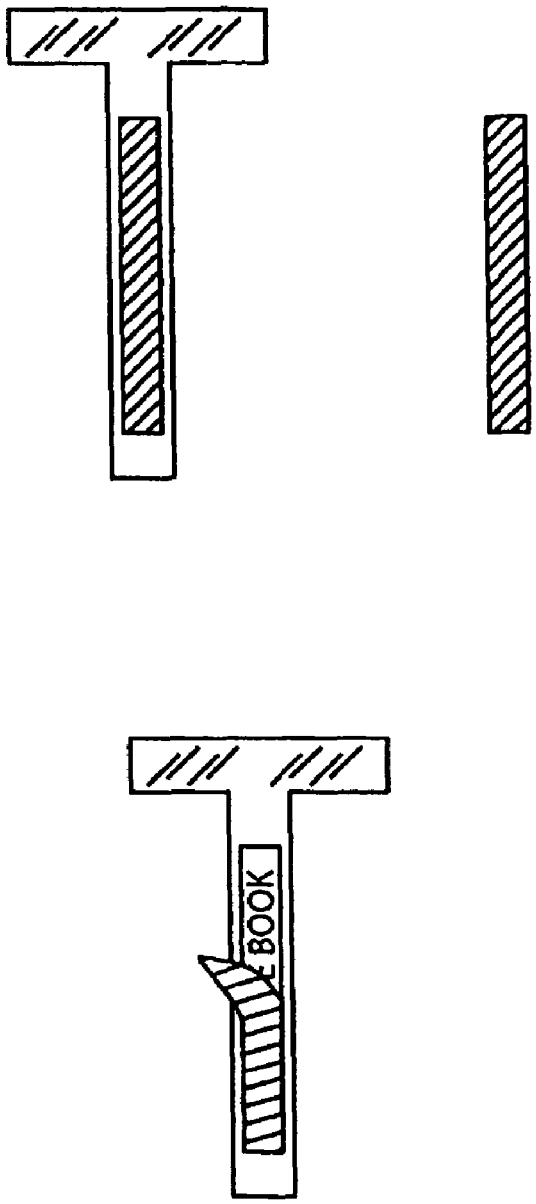
Figure 46:
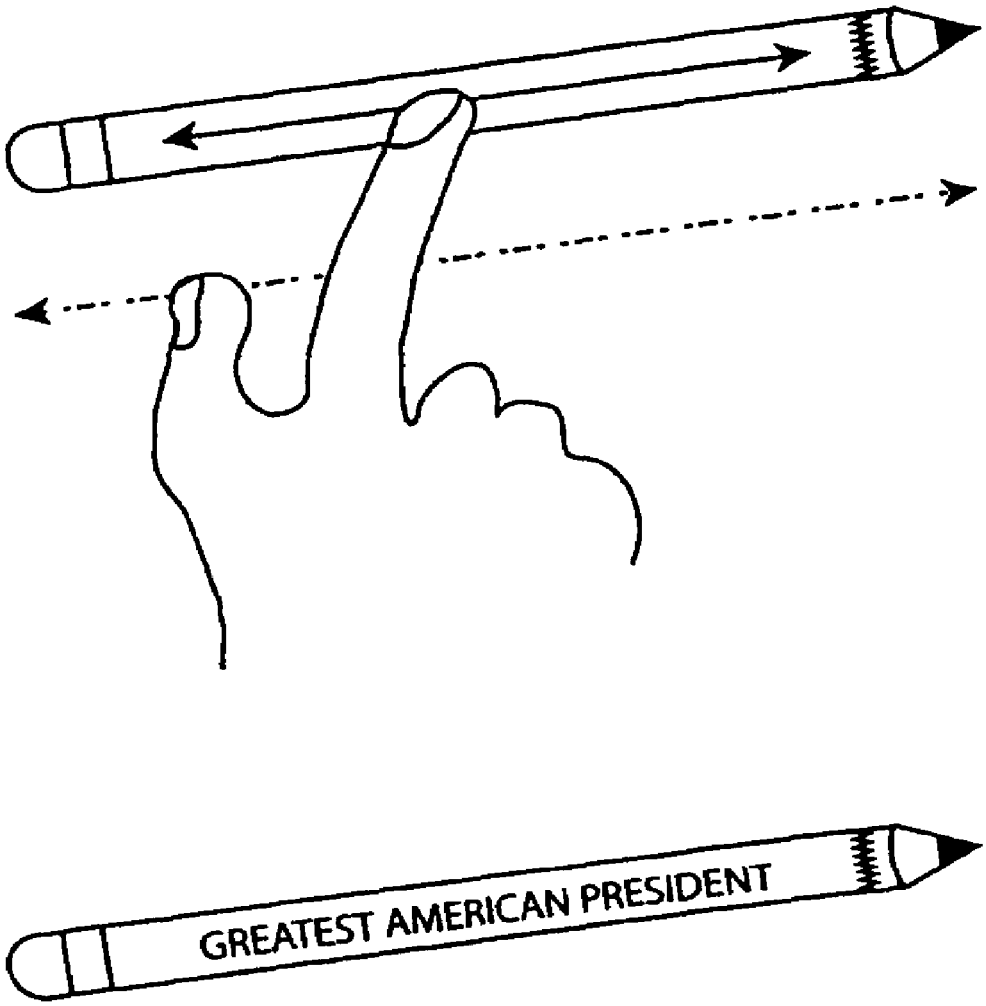
Figure 47:
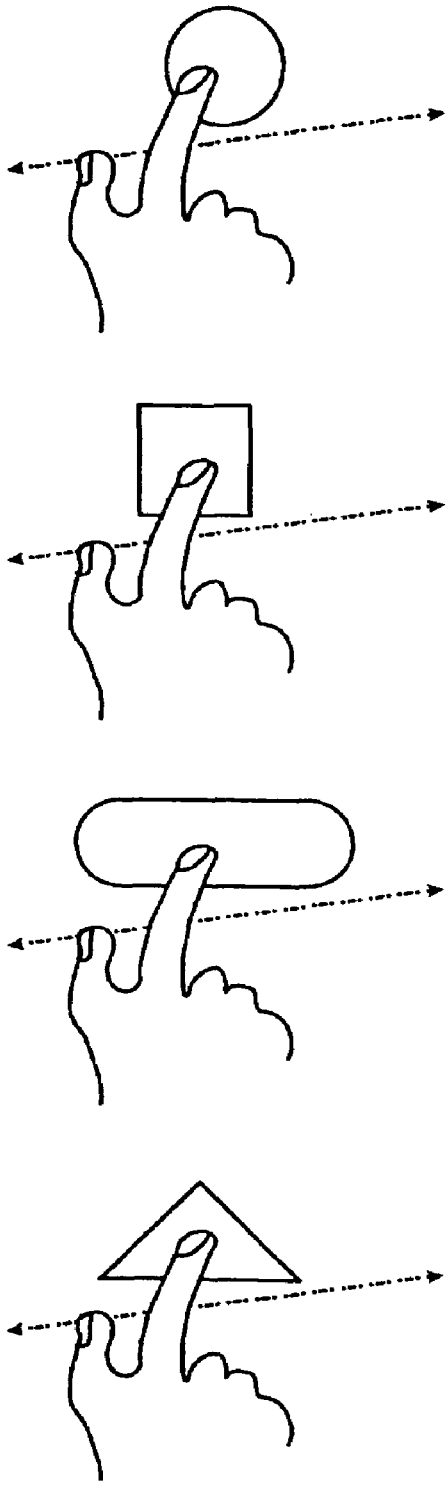
Figure 48:
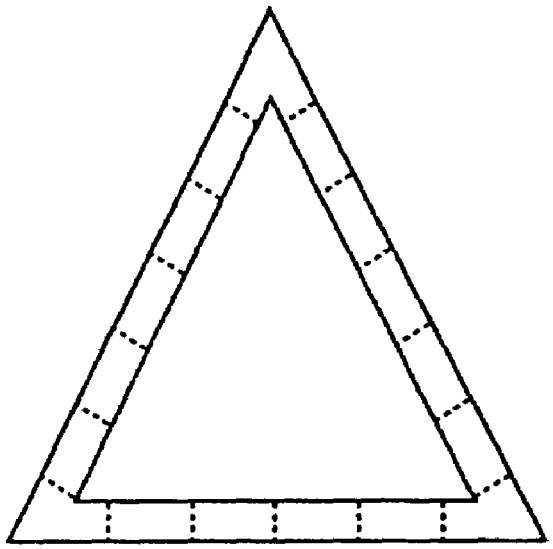
Figure 48:
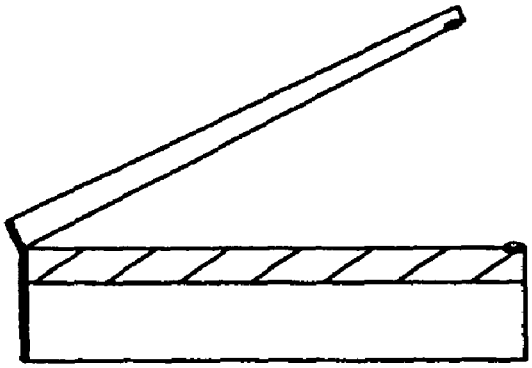
Figure 49:
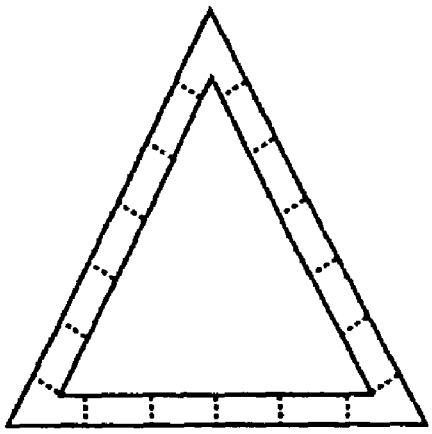
Figure 49:
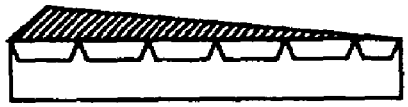
Figure 49:
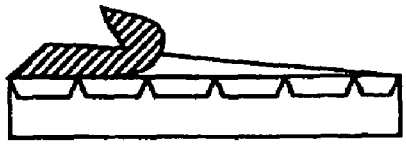
Figure 50:
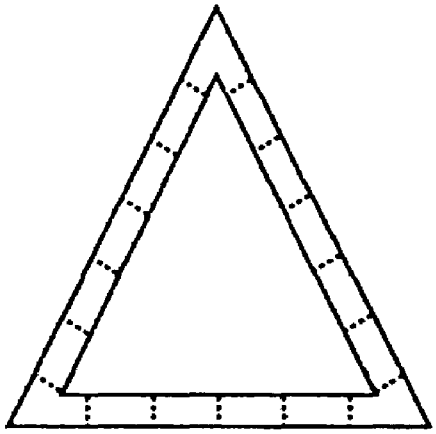
Figure 50:
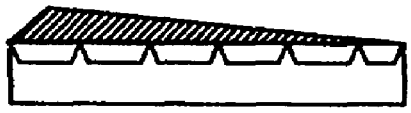
Figure 50:
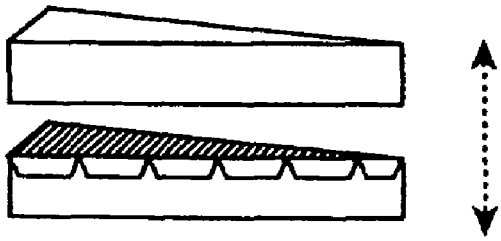
Figure 51:
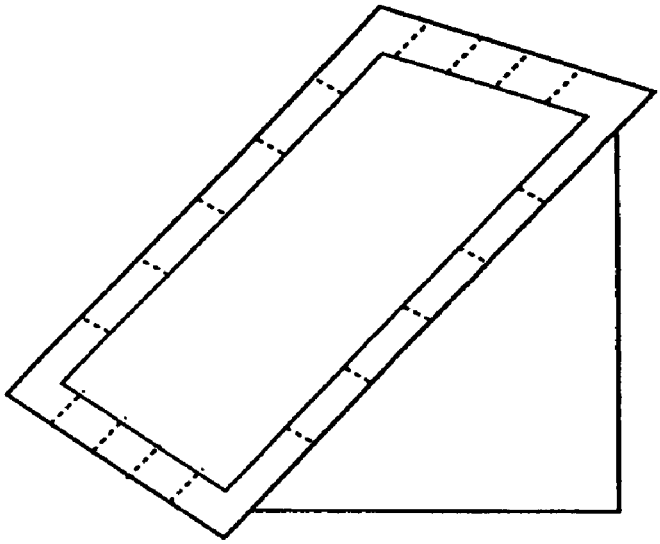
Figure 51:
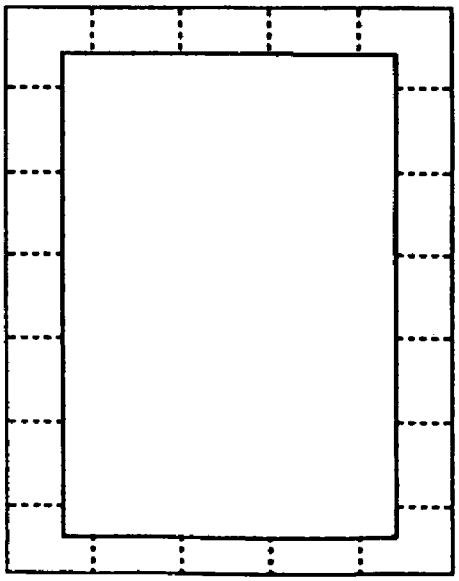
Figure 52:
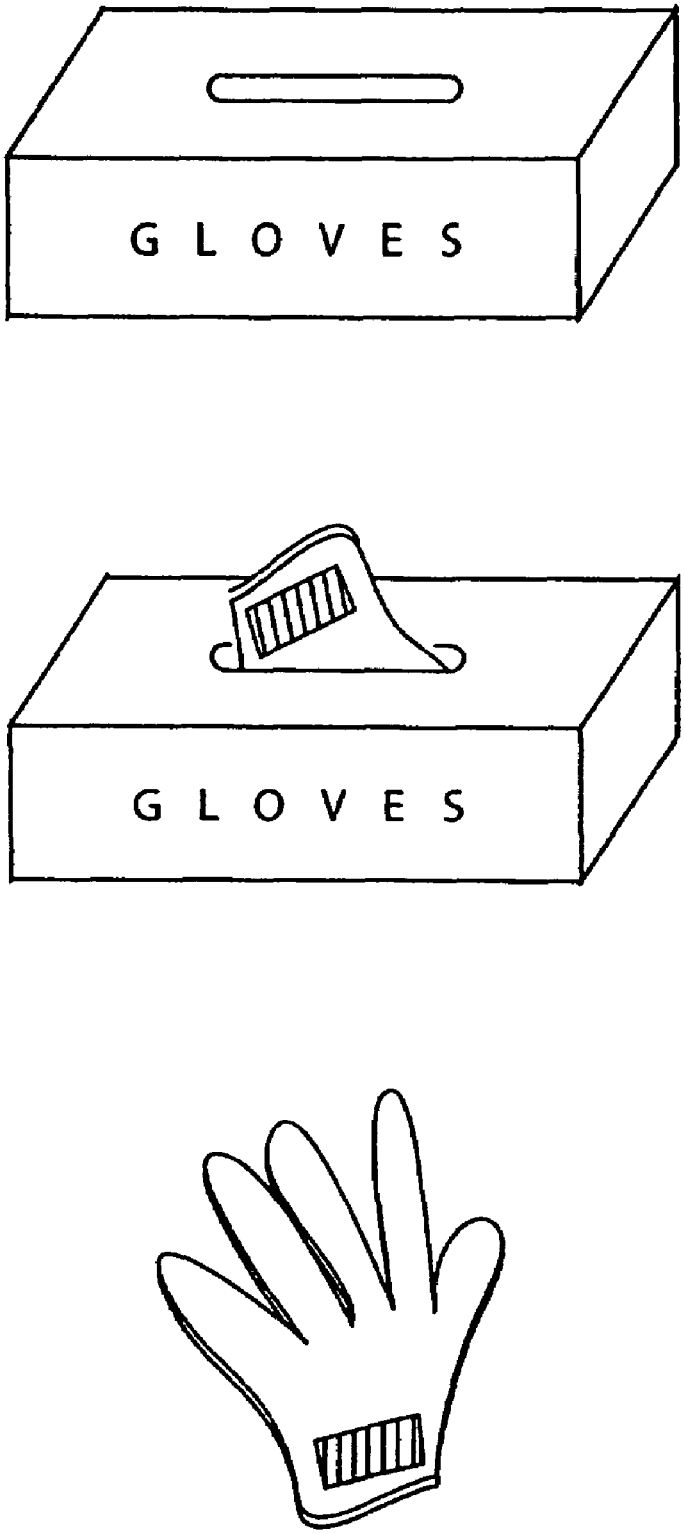

As best seen in FIG. 22, revealing member 82 of an object 80 is provided having a handle member 84 that is fixedly mounted to conversationware piece 12, preferably, handle member 84 is fastened to conversationware piece 12 along a spine portion 86 such that revealing member 82 covers or at least obscures open-ended question 18 printed therebelow to prevent or deter a conversation partner from reading open-ended question 18 prior to a discussion or conversation. Handle member 84 further includes a pair of generally D-shaped wings 88 flexibly coupled to spine portion 86. D-shaped wings 88 are normally folded generally flush with the outer surface of conversationware piece 12 to facilitate storage, transport, and to cover or at least obscure open-ended question 18. D-shaped wings 88 may be folded outward to revel open-ended question 18 and further permit use of handle member 84. That is, spine portion 86 forms an interface between handle member 84 and conversationware piece 12 such that handle member 84 supports conversationware piece 12. Spine portion 86 of handle member 84 is fixed to conversationware piece 12 via an adhesive or similar material, such as glue.

Open-ended question or command 18 is generally defined as a question or command that allows for a spontaneous, unstructured response that typically has no right or wrong answer. Open-ended questions or commands commonly allow a respondent to elaborate on their own personal thoughts, opinions, feelings, or experience relating to a specific topic. Preferably, open-ended question or command 18 is chosen from topics relating to politics, history, movies, theatre, sports, children, marriage, dating, religion, famous people, television, education, alma maters, space, general matters, personal experiences, festive occasions, and the like. It should be noted that open-ended question 18 may be any question that allows for a spontaneous, unstructured response, irrespective of the particular category it may relate to. By way of non-limiting example, the following open-ended questions represent a varied cross-section of possible alternatives that are believed to elicit a spontaneous, unstructured response:

1 General Category

1.) If you could invite a person in history to have dinner with you, who would it be and what would you discuss?
2.) Which relative or acquaintance makes you want to "run for cover," when they announce they are coming for a visit, and why?

Politics and History

1.) Which U.S. political figure has made the most important contribution to our society and what was that contribution?
2.) Which top five inventions have made the most impact on our culture?

Movies and Theater

1.) If you could spend a weekend "on location" during the filming of a movie with your favorite actor, who would it be?
2.) What movie should be a requirement for all children to see?

The Sporting Life

1.) Choose a sport and describe how certain aspects of the sport mimic life and its uncertainties.
2.) Which American athlete presents the best qualities of a role model for youth and why?

Children or Adults

-continued

1.) What did you do to receive the most memorable punishment of your life?
2.) You are preparing to leave for school, what do you hear your Mom or Dad saying?

Dating Fun

1.) What was your worst date?
2.) What physical characteristics do you appreciate most in a potential date?

Married Life

1.) You are talking to a young person about to marry, what three pieces of advice do you give?
2.) What was the funniest event that occurred during your wedding and/or on your honeymoon?

Spiritual

1.) Which verse provides you with the most inspiration for dealing with life's difficulties?
2.) You and God are dining, what do you say to Him and what does He say to you?

Preferably, each guest receives at least one conversationware piece 12. This conversationware piece 12 includes a unique open-ended question 18 that is directed to an area or subject within a category. It is also anticipated that one conversationware piece 12 may include a first part of open-ended question 18, while the remainder of such open-ended question 18 is completed on one or more other conversationware pieces 12. In this way, it is possible to lead up to the final question over various courses in the meal or dining experience. Moreover, it is possible to create sets of conversationware pieces 12 that must all be used to "piece" open-ended question 18 together. It is therefore possible for the question not to be read immediately ion its entirety until the second (or additional) conversation pieces have been presented to the guests. Open-ended questions 18 may includes a color-coding system to facilitate the rapid identification of a particular category, subject, or to identify a maturity level to which the question is directed.

The use of conversation-generating apparatus 10 will now be described in further detail. As set forth above, the present invention may be used for a variety of entertaining situations, social gatherings, or personal, intimate occasions. It should be understood that in order to achieve the benefits of the present invention, it is only necessary to have a single conversationware piece 12 having a single open-ended question 18 disposed thereon. However, in the interest of brevity, the use of conversation-generating apparatus 10 will be described with reference to a dinner party environment or other formal occasion. Place settings for formal dinner parties typically include the largest number of individual conversationware pieces, such as plates, saucers, chargers, bowls, cups, glasses, goblets, napkin holders, napkins, placemats, name cards, place cards, table utensils, table decorations, party favors, and the like and, thus, provide the opportunity for the most complete description of the preferred embodiment. However, this detailed description shall not be interpreted to limit this application in that this invention may be used with a single conversationware piece with a single open-ended question or command printed thereon.

To use conversation-generating apparatus 10, each guest or conversation partner randomly receives conversationware 12. Preferably, each piece of conversationware 12 may include open-ended question or command 18 printed on unexposed surface 16 or behind revealing member 54 (hereinafter collectively including 54, 64, 74, 84). The printing of open-ended question or command 18 on unexposed surface 16 or behind revealing member 54 prevents each guest from knowing his/her questions. This prevents each guest from knowing and preparing a response to the open-ended question beforehand. Consequently, the intent of eliciting spontaneous, unstructured answers and opinions is maintained. However, it is anticipated that in the alternative, open-ended question or command 18 may be printed on exposed surface 14 of conversationware 12. When these questions or commands are printed on exposed surface 14, they may be obscured from view by food or beverage or may be revealed to the guest upon sitting at the table. The specific time at which the open-ended questions or commands are revealed to the guest may be determined by the host and may be tailored, to suit the desired atmosphere of the social gathering.

At a time to be determined by the host, each guest is asked to uncover, if necessary, the open-ended question or command that is placed on a specific piece of conversationware and read it aloud to the remaining guests. This may preferably be done, for example, prior to the serving of the next course. The guest then answers the open-ended question or command aloud, thereby sharing with the remaining guests their own thoughts, opinions, feelings, and/or experiences relating to the topic. The remaining guests are then engaged in a group discussion relating to the open-ended question or command and/or the answer(s) provided by their fellow guest(s). Once the group discussion is substantially exhausted or at a time determined by the host, another guest is asked to read aloud and answer aloud the open-ended question or command printed on one of their specific pieces of conversationware and the process is repeated for each guest.

Alternatively, one guest may read the open-ended question or command, while another guest responds to the question or command, it is important to note that there may be variations to this method that are within the scope of this application which still provide for eliciting a spontaneous, unstructured response to facilitate conversation among guests.

By providing each guest with multiple conversationware pieces having a different open-ended question or command printed thereon, each guest may have multiple turns of reading aloud and answering aloud their specific questions or command. it is also anticipated that the present invention may be used by two or more dining or social partners. For example, the present invention may be particularly useful in quickly getting to know the personal opinions and/or experiences of someone that one is dating or seeking to employ.

By way of an additional non-limiting example, conversation-generating apparatus 10 may also be used between only two persons. These two persons may in fact be very familiar with each other. However, conversation-generating apparatus 10 is useful to further the development of an interpersonal relationship therebetween. For example, the piece of conversationware 12 of conversation-generating, apparatus 10 may be simply a tray-liner at a fast food restaurant. This tray-liner includes thereon a selectively revealable open-ended question 18. A first conversation partner, for instance a teenager, may reveal the open-ended question 18, possibly pertaining to sports, drugs, or the like. The teenager then reads the open-ended question 18 and provides a spontaneous, unstructured response thereto. The parent is then able to respond to the answer to further help foster a communicative relationship and understanding between the parent and teenager. Although this may be a simplified example, it should be appreciated that such use of conversation-generating apparatus 10 provides numerous unique uses and benefits.

It will thus be seen that the objects set forth above, among those made apparent from the preceding description, are efficiently attained and, because certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A conversation promoting apparatus comprising:

a first utilitarian object, the first utilitarian object including at least one first selectively actuatable microchip preprogrammed with at least one first signal, a first transmitter for transmitting the at least one first signal when the first microchip is actuated, and a first receiver; and a second utilitarian object, the second utilitarian object including at least one second selectively actuatable microchip preprogrammed with at least one second signal, a second transmitter for transmitting the at least one second signal when the second microchip is actuated, and a second receiver for receiving the at least one first signal transmitted by the first utilitarian object, wherein, upon receipt of the at least one first signal transmitted by the first utilitarian object, the second utilitarian object emits the at least one first signal, and wherein the first receiver of the first utilitarian object receives the at least one second signal transmitted by the second utilitarian object and, upon receipt of the at least one second signal, the first utilitarian object emits the at least one second signal and wherein the first and second selectively actuatable microchips are programmed to cooperate to emit consecutive signals that comprise portions of a monologue.

2. The conversation promoting apparatus according to claim 1, wherein the at least one first signal is an open-ended opinion-evoking statement.

3. The conversation promoting apparatus according to claim 1, wherein the at least one first signal is one of a question and answer.

4. The conversation promoting apparatus according to claim 1, wherein the first utilitarian object is provided with indicia at the location of each of the at least one first microchip, the indicia relating to the first signal preprogrammed into the first microchip.

5. The conversation promoting apparatus according to claim 1, wherein the first microchip is actuated by at least one of an application of heat, light, a remote signal, and pressure imparted to the first microchip.

6. The conversation promoting apparatus according to claim 1, wherein the first and second utilitarian objects are one of a plate, a cup, a napkin, a napkin holder, a swizzle stick, a mixer, a glass, and a placemat.

7. The conversation promoting apparatus according to claim 1, wherein the first and second utilitarian objects are provided with indicia at the location of each of the respective first and second microchips, the indicia indicating proper sequence for the consecutive signals.

8. The conversation promoting apparatus according to claim 1, wherein the first and second microchips automatically recognize the proper sequence for the consecutive signals.

9. The conversation promoting apparatus according to claim 1, wherein the at least one second signal is an open-ended opinion-evoking statement.

10. The conversation promoting apparatus according to claim 1, wherein the at least one second signal is one of a question and answer.

11. The conversation promoting apparatus according to claim 1, wherein the second utilitarian object is provided with indicia at the location of each of the at least one second microchip, the indicia relating to the second signal preprogrammed into the second microchip.

12. The conversation promoting apparatus according to claim 1, wherein the second microchip is actuated by at least one of an application of heat, light, a remote signal, and pressure imparted to the second microchip.

* * * * *